US006519911B1

(12) United States Patent
Sawada

(10) Patent No.: US 6,519,911 B1
(45) Date of Patent: Feb. 18, 2003

(54) STRUCTURAL MEMBER, STRUCTURAL UNIT, METHOD FOR MANUFACTURING A STRUCTURAL MEMBER, AND METHOD FOR MANUFACTURING A STRUCTURAL UNIT

(75) Inventor: Taiichi Sawada, Clear Island Waters (AU)

(73) Assignee: CDS Nu-Steel Homes International Co., Ltd., Tokyo (JP)

( * ) Notice: Subject to any disclaimer, the term of this patent is extended or adjusted under 35 U.S.C. 154(b) by 0 days.

(21) Appl. No.: 09/698,752

(22) Filed: Oct. 27, 2000

(30) Foreign Application Priority Data

Oct. 29, 1999 (AU) ..... PQ 3763

(51) Int. Cl.[7] ..... E04C 3/30

(52) U.S. Cl. ..... 52/730.4; 52/730.6; 52/732.1; 52/745.19; 52/309.9

(58) Field of Search ..... 52/730.4, 730.5, 52/730.6, 732.1, 732.2, 737.2, 737.6, 729.1, 729.2, 729.5, 745.19, 309.9, 309.14

(56) References Cited

U.S. PATENT DOCUMENTS

| | | | | | |
|---|---|---|---|---|---|
| 3,977,149 | A | * | 8/1976 | Haynes et al. | 52/731 |
| 4,192,119 | A | * | 3/1980 | Murphy | 52/588 |
| 4,580,380 | A | * | 4/1986 | Ballard | 52/309.9 |
| 5,095,678 | A | * | 3/1992 | Murphy | 52/731 |

* cited by examiner

*Primary Examiner*—Carl D. Friedman
*Assistant Examiner*—Naoko Slack
(74) *Attorney, Agent, or Firm*—Rosenthal & Osha L.L.P.

(57) ABSTRACT

A structural member for constructing a building comprising: a pair of structural elements, each of which includes three channels opening alternately towards opposite directions and has a substantially uniform cross section along a longitudinal direction; and a connecting member which connects the pair of structural members.

19 Claims, 21 Drawing Sheets

32B

34B

STRUCTURAL MEMBER, STRUCTURAL UNIT, METHOD FOR MANUFACTURING A STRUCTURAL MEMBER, AND METHOD FOR MANUFACTURING A STRUCTURAL UNIT

This patent application claims priority based on an Australian Provisional patent application, PQ3763 filed on Oct. 29, 1999, the contents of which are incorporated herein by reference.

BACKGROUND OF THE INVENTION

1. Field of the Invention

The present invention relates to a structural member. More particularly, the present invention relates to a structural member, method for manufacturing a structural member, a structural unit, and a method for manufacturing a structural unit.

2. Description of the Related Art

In the case where steel material is used for constructing a structure such as a house, building, or a warehouse, a channel section that has a C-shaped cross-section is generally used as a steel material. The channel section is generally formed by bending a steel plate, the thickness of which is usually from 0.8 to 1.5 mm, to have a C-shaped cross-section. The framework of a building can be constructed by using the channel section as a column, beam and diagonal brace and by combining the channel sections. However, the weight of the channel section must be high to have the necessary strength. Moreover, it is difficult to position a plurality of the channel sections when combining and connecting a plurality of channel sections with each other .Therefore, it is difficult for an ordinary person to construct a building using a channel section. The cost for constructing a structure is therefore expensive.

Therefore, to increase the strength of the steel material, which is used for constructing a Structure, and to reduce the cost of constructing the structure, the above-mentioned channel section problems must be overcome.

SUMMARY OF THE INVENTION

Therefore, it is an object of the present invention to provide a structural member and method for manufacturing a structural member which overcomes the above issues in the related art. This object is achieved by combinations described in the independent claims. The dependent claims de fine further advantageous and exemplary combinations of the present invention.

According to the first aspect of the present invention, a structural member for constructing a structure comprises: a pair of structural elements, each of which includes three channels opening alternately towards opposite directions and has a substantially uniform cross section along a longitudinal direction; and a connecting member which connects the pair of structural members. The structural member may further comprise a filling member provided in a space formed by the pair of structural elements and the connecting member. Expanded polystyrene may be used for the filling member.

Each of the three channels of the structural element may be substantially rectangular. The structural element may have first, second, third, fourth, fifth, sixth, and seventh substantially rectangular planar portions, neighboring faces of which are substantially perpendicular to each other. Each of the widths of the three channels may be substantially equal. Each of the heights of the three channels may be substantially equal The structural element may be made from metal. The structural element may be made from high-tensile steel.

The pair of structural elements maybe aligned and connected to each other by the connecting member such that each of the side channels of the three channels of one of the structural elements faces the corresponding aide channels of another the structural element, respectively. The pair of structural elements may have pair of the connecting members; and the planer portions of each of the pair of structural elements, which are corresponded to each other, may be connected to each other by the pair of connecting members.

The structural element may have a concave part, which connects the structural element and the connecting member. The structural element may have a rivet, a drilling screw, a tapping screw, a screw nail, a bolt, or a welding, which connects the structural element and the connecting member.

The connecting member may be a pair of channel sections, each of which has one bottom face and two side faces. The two side faces of one of the channel section of the pair of channel sections may engage with the inner face of the second planar portions of each of the pair of structural elements; and the two side faces of another the channel section of the pair of channel sections may engage with the inner face of the sixth planar portions of each of the pair of structural elements.

The bottom face of one of the channel section of the pair of channel sections may engage with each of the third planar portions of the pair of structural elements; the bottom face of another the channel section of the pair of channel sections may engage with each of the fifth planar portions of the pair of structural elements; and a space having a substantially rectangular cross section is formed by the pair of channel sections and the pair of structural elements. The structural member may further comprise a filling member provided in a space formed by the pair of structural elements and the connecting member. The structural member may constitute a straining beam or a column of the structure.

The bottom face of one of the channel section of the pair of channel sections may engage with each of inner faces of the first planar portions of the pair of structural elements; the bottom face of another the channel section of the pair of channel sections may engage with each of the inner faces of the seventh planar portions of the pair of structural elements; and a space having a substantially H-shaped cross section may be formed by the pair of channel sections and the pair of structural elements. The structural member may further comprise a filling member provided in a space formed by the pair of structural elements and the connecting member. The structural member may constitute a main beam of the structure.

Two side faces of one of the channel section of the pair of channel sections may engage with the outer faces of the second planar portions of each of the pair of structural elements; and a bottom face of one of the channel section of the pair of channel sections may engages with the outer faces of each of the first planar portions of the pair of structural elements; and two side faces of another the channel section of the pair of channel sections may engage with the outer faces of the sixth planar portions of each of the pair of structural elements; and a bottom face of another the channel section of the pair of channel sections may engage with the outer faces of each of the seventh planar portions of the pair of structural elements; and a space having a substantially H-shaped cross section may be formed by the pair of channel sections and the pair of structural elements.

The structural member may further comprise a filling member provided in a space formed by the pair of structural elements and the connecting member. The structural member may constitute a main beam of the structure.

The connecting member may be a pair of steel plates, each of which has a substantially rectangular plan. One of the steel plates of the pair of steel plates may engage with the third planar portions of each of the pair of structural elements; and another steel plate may engage with the fifth planar portions of each of the pair of structural elements; and a space having a substantially rectangular cross section may be formed by the pair of steel plates and the pair of structural elements. The structural member may further comprise a filling member provided in a space formed by the pair of structural elements and the connecting member The structural member may constitute a straining beam or a column of the structure.

One of the steel plate of the pair of steel plates may engage with the inner face of the first planar portions of each of the pair of structural elements; and another steel plate may engage with the inner face of the seventh planar portions of each of the pair of structural elements; and a space having a substantially H-shaped cross section may be formed by the pair of steel plates and the pair of structural elements. The structural member may further comprise a filling member provided in a space formed by the pair of structural elements and the connecting member. The structural member may constitute a main beam of the structure.

According to the second aspect of the present invention, a structural unit for constructing a structure comprising: at least two structural members each including: pair of structural elements, each of which includes three channels opening alternately towards opposite directions and has a substantially uniform cross section along a longitudinal direction; and a connecting member which connects the pair of structural members; and a connector that connects at least two the structural members.

The structural unit may further comprise a filling member provided in a space formed by the pair of structural elements and the connecting member. A pair of the structural members may be connected by the connector such that the second and sixth planar portions of the structural element of one of the pair of structural members engage with the second and sixth planar portions of the structural element of another the structural member, respectively. The connector may be a pipe having a substantially rectangular cross section. The connector may engage with the third, fourth, and fifth planar portions of one of the pair of structural members and the connector further engages with the third, fourth, and fifth planar portions of another the structural member.

One end of one of the at least two structural members may be connected to one end of another the at least two structural members serially in a longitudinal direction by the connector. The connector may engage with each of the fourth planar portions of the pair of structural elements of one of the at least two structural members, and the connector may further engage with each of the fourth planar portions of the pair of structural elements of another the structural member.

According to the third aspect of the present invention, a method for manufacturing a structural member which constitutes a structure comprises: forming a structural element by bending a steel plate to form three channels alternately opening towards opposite directions; and connecting pair of the structure elements by a connecting member.

The method for manufacturing a structural member may further comprise providing a filling member in a space formed by the pair of structural elements and the connecting member expanded polystyrene may be used for the filling member. The forming the structural element may form each of the three channels of the structural elements substantially rectangular.

The forming the structural element may bend the steel plate such that neighboring faces of which are perpendicular to each other to form seven substantially rectangular planar portions. The forming the structural element may form each width of the three channels of the structural element to be substantially equal. The forming the structural element may form each height of the three channels of the structural element to be substantially equal. The forming the structural element may form the structural element from metal. The forming the structural element may form the structural element from high-tensile steel.

The connecting the pair of structural elements may align the pair of structural elements such that each of the side channels of the three channels of one of the structural elements faces the corresponding side channels of another the structural element, respectively; and may connect aligned the pair of structural elements by the connecting member. The connecting the pair of structural elements may connect the planer portions of each of the pair of structural elements, which correspond to each other, by pair of the connecting members. The connecting the pair of structural elements may format least one concave part on a portion of the structural element where the planar portions of the structural element and the connecting member engages with each other.

The connecting the pair of structural elements may fixe a portion, where the planar portions of the structural element and the connecting member engages with each other, by a rivet, a drilling screw, a tapping screw, a screw nail, a bolt, or a welding.

According to the fourth aspect of the present invention, a method for manufacturing a structural unit that constitutes a structure comprising: forming a structural member by forming a structural element by bending a steel plate to form three channels alternately opening towards opposite directions and connecting pair of the structure elements by a connecting member; and connecting the at least two structural members by a connector.

The forming the structural element may form each of the three channels of the structural element substantially rectangular. The forming the structural element may bend the steel plate such that neighboring faces of which are perpendicular to each other to form first, second, third, fourth, fifth, sixth, and seventh substantially rectangular planar portions.

The connecting the pair of structural elements may align the pair of structural elements such that each of the side channels of the three channels of one of the structural elements faces corresponding the side channels of another the structural element, respectively; and may connect aligned the pair of structural elements by the connecting member.

The connecting the at least two structural members may connect at least two structural members such that the second and sixth planar portions of the structural element of one of the at least two structural members engages with the second and sixth planar portions of the structural element of another the structural member, respectively.

A pipe that has a substantially rectangular cross section may be used for the connector The connecting the at least two structural members may arrange the connector to be engaged with the third, fourth, and fifth planar portions of one of the pair of structural members and to be engaged with the third, fourth, and fifth planar portions of another the structural member.

The connecting the at least two structural members may connect one end of one of the at least two structural members to one end of another the structural member serially in a longitudinal direction by the connector. A pipe that has a substantially rectangular cross section may be used for the connector.

The connecting the at least two structural members may connect the at least two structural members by the connector such that the connector engages; with each of the fourth planar portions of the pair of structural elements of one of the at least two structural members, and the connector may further engage with each of the fourth planar portions of the pair of structural elements of another the structural member.

This summary of the invention does not necessarily describe all necessary features of the present invention. The present invention may also be a sub-combination of the above described features. The above and other features and advantages of the present invention will become more apparent from the following description of embodiments taken in conjunction with the accompanying drawings.

Fog. 17 shows another embodiment of a connector.

Figure 18:
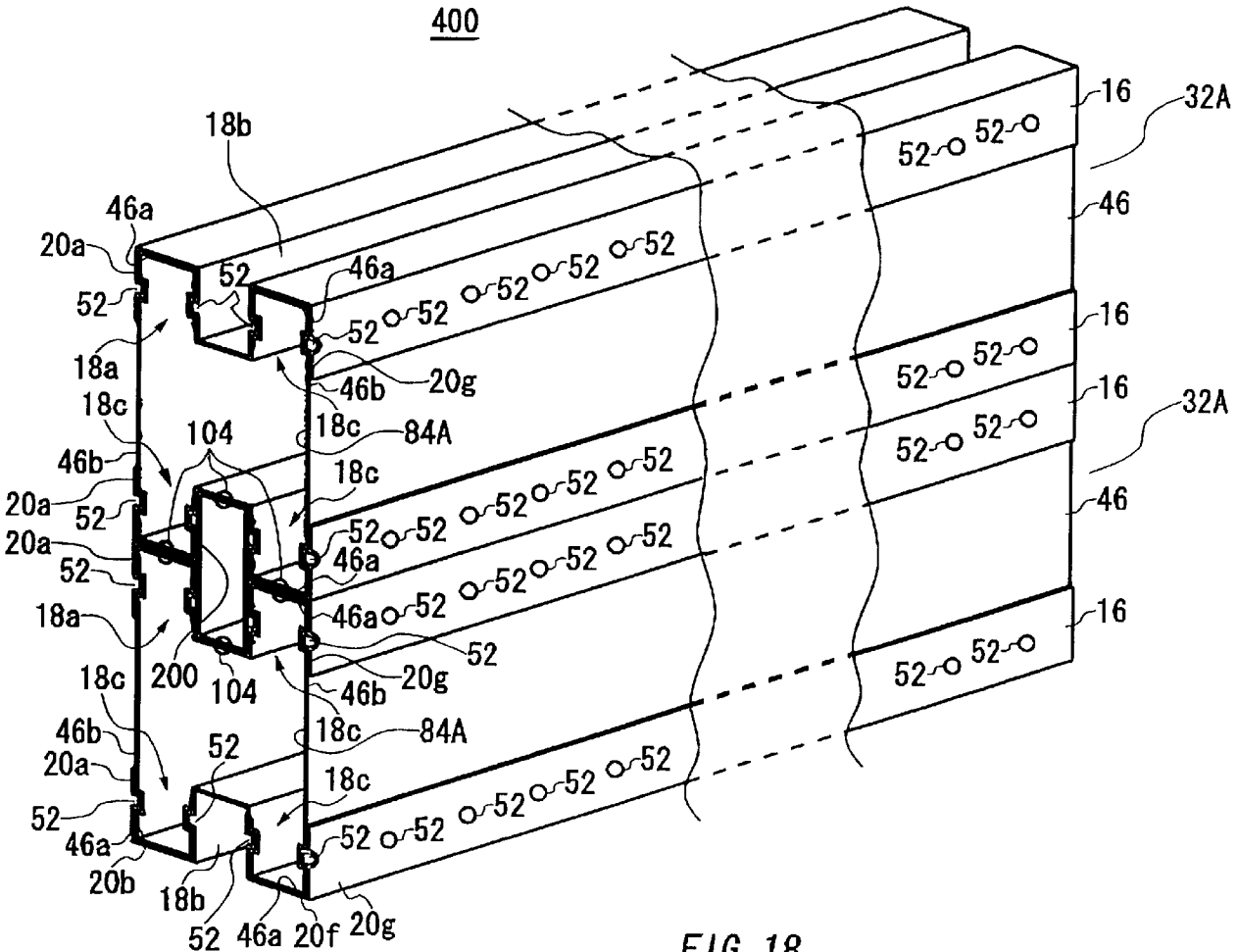

FIG. 18 shows a perspective view of a structural unit 400.

Figure 19:
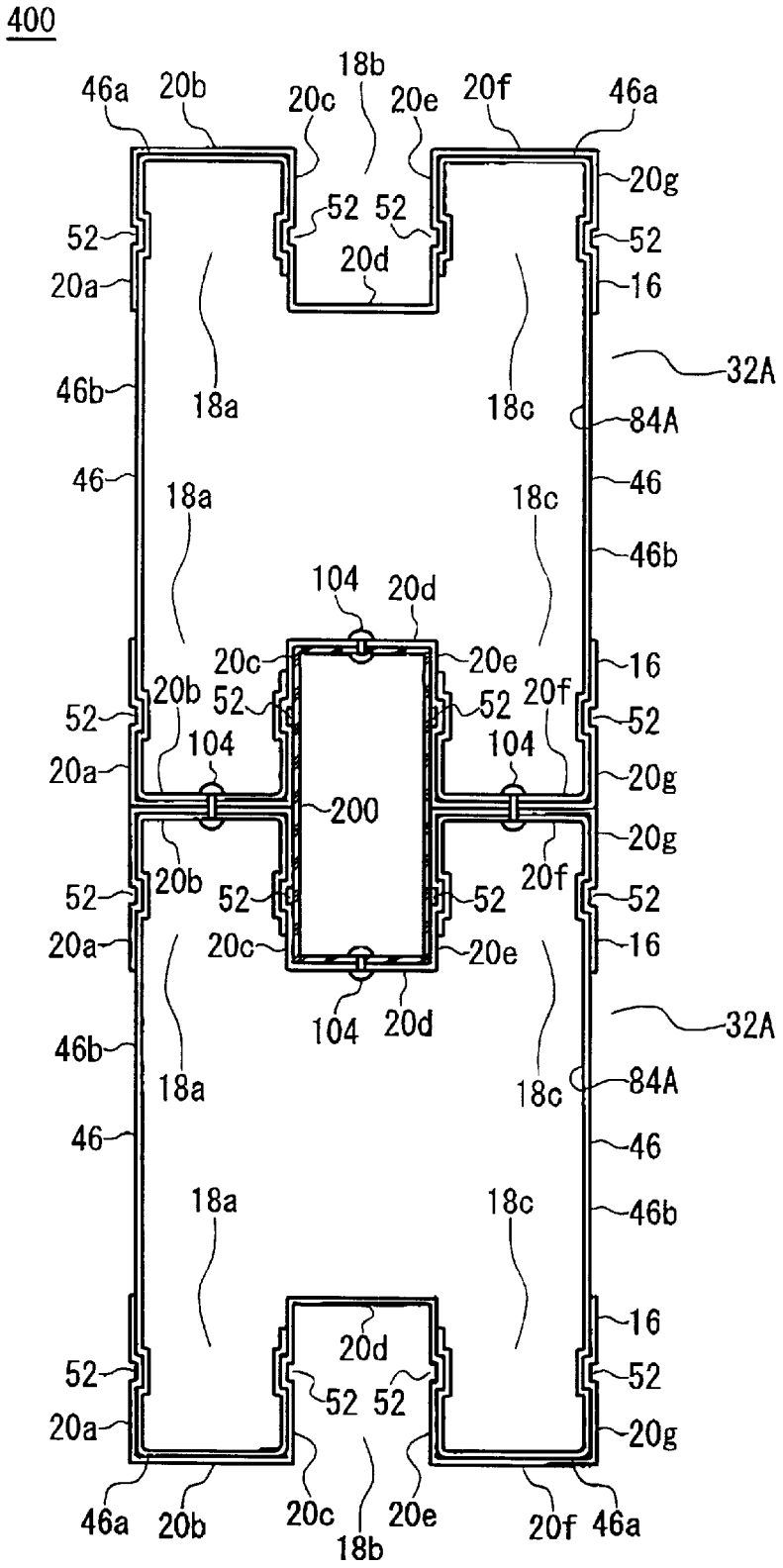

FIG. 19 shows a cross section of the structural unit shown in FIG. 18.

Figure 20:
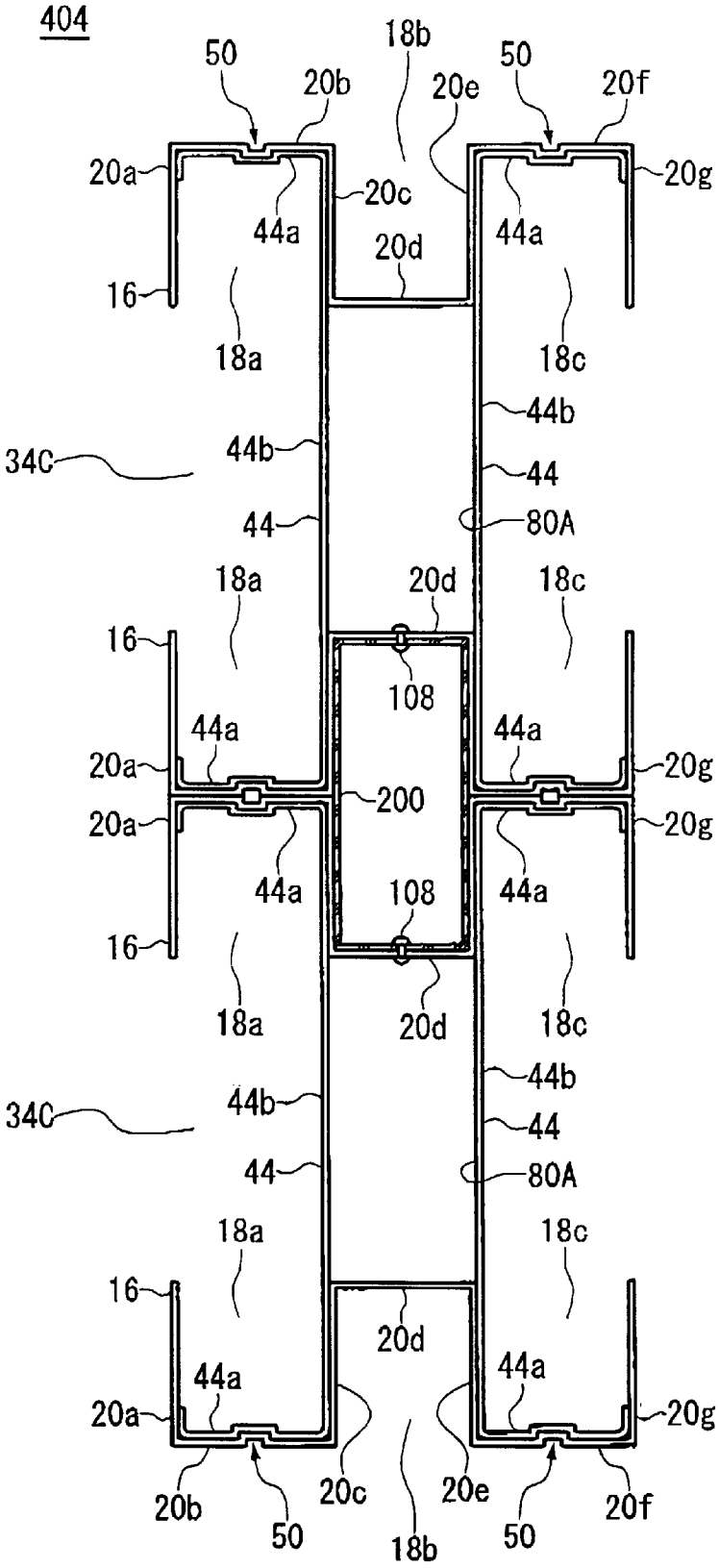

FIG. 20 shows an example of the structural unit that uses the structural member 34C instead of the structural member 32A.

Figure 21:
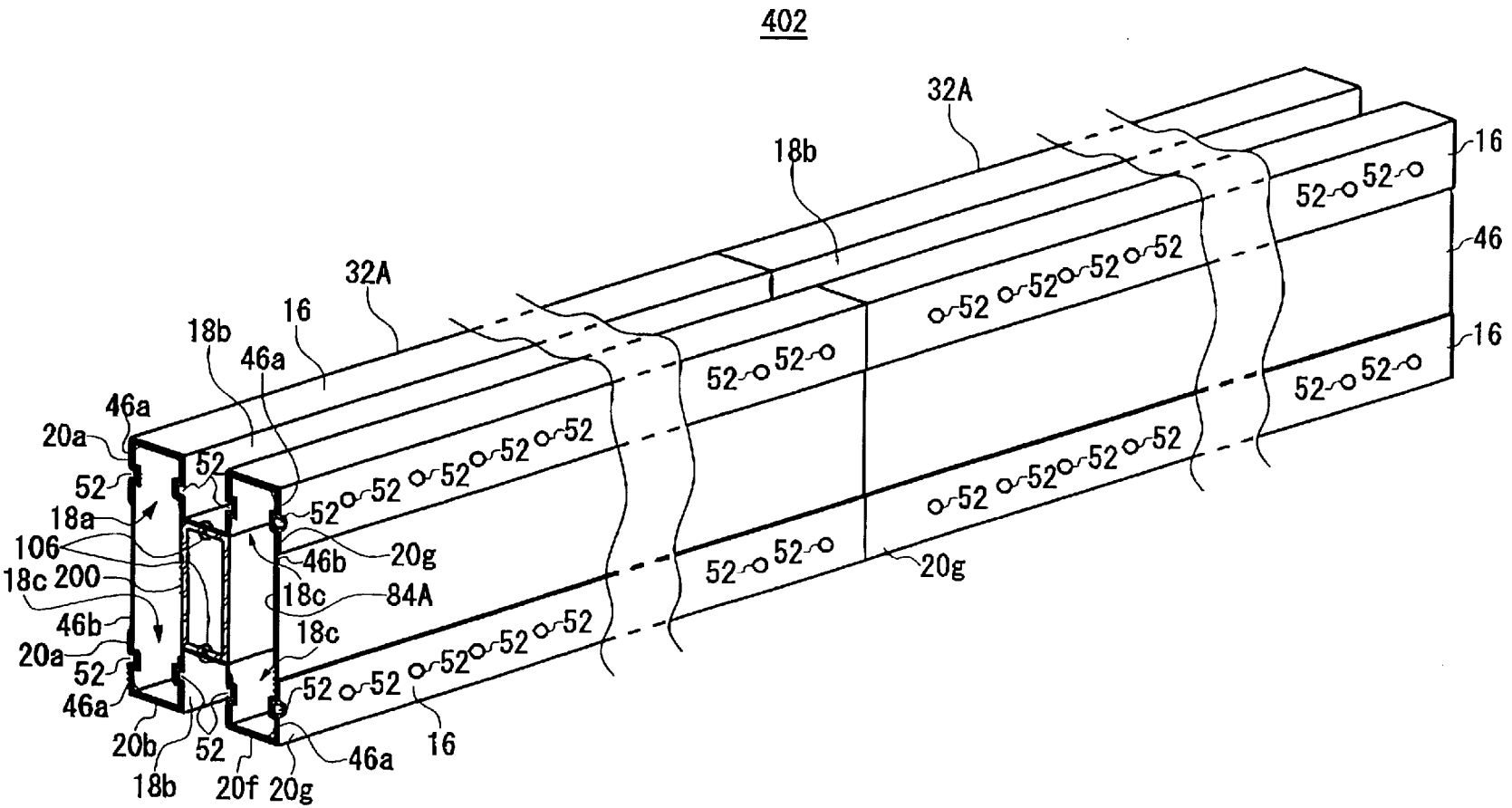

FIG. 21 shows a perspective view of the structural unit 402.

Figure 22:
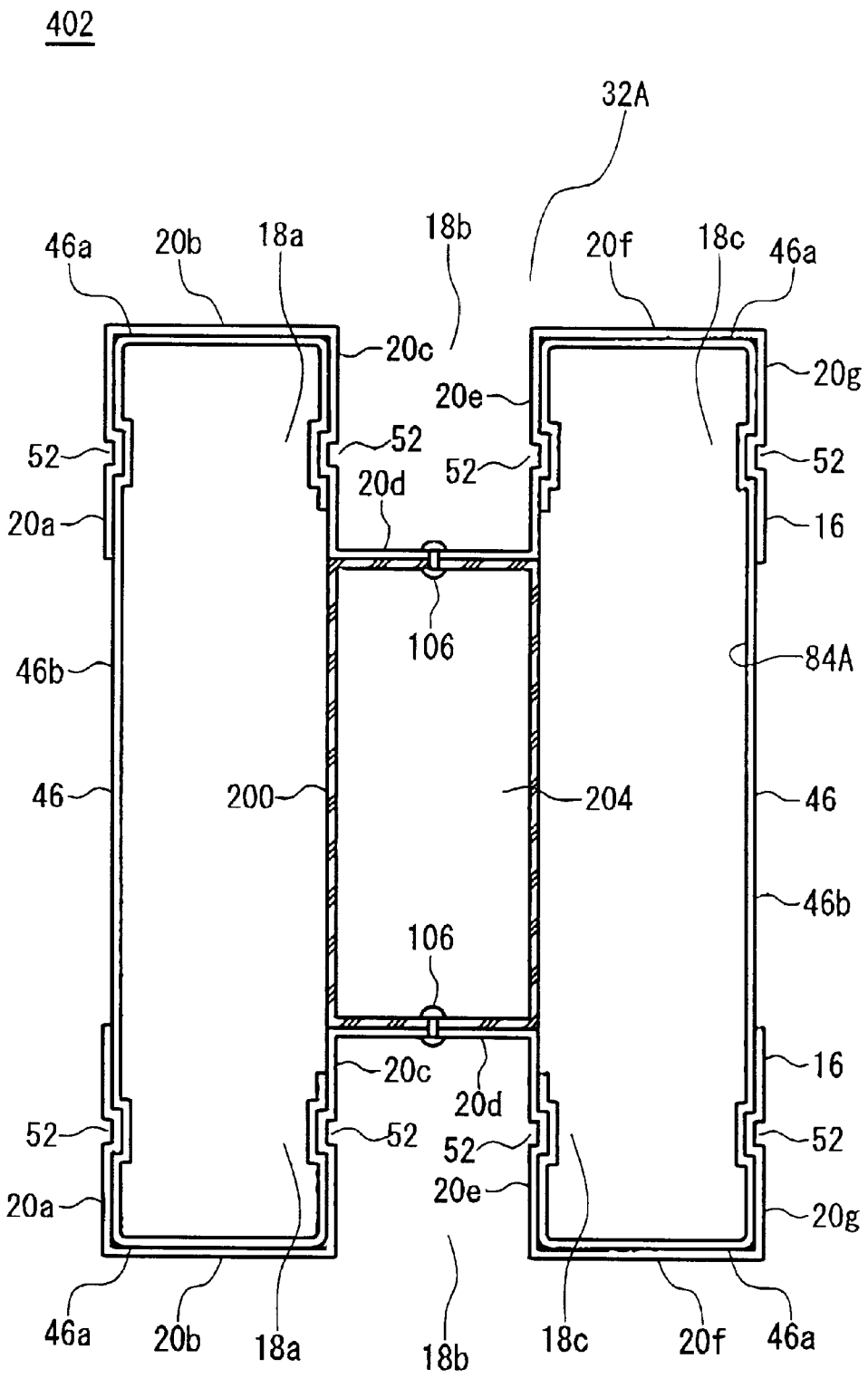

FIG. 22 shows a cross section of the structural unit shown in FIG. 21.

Figure 23:
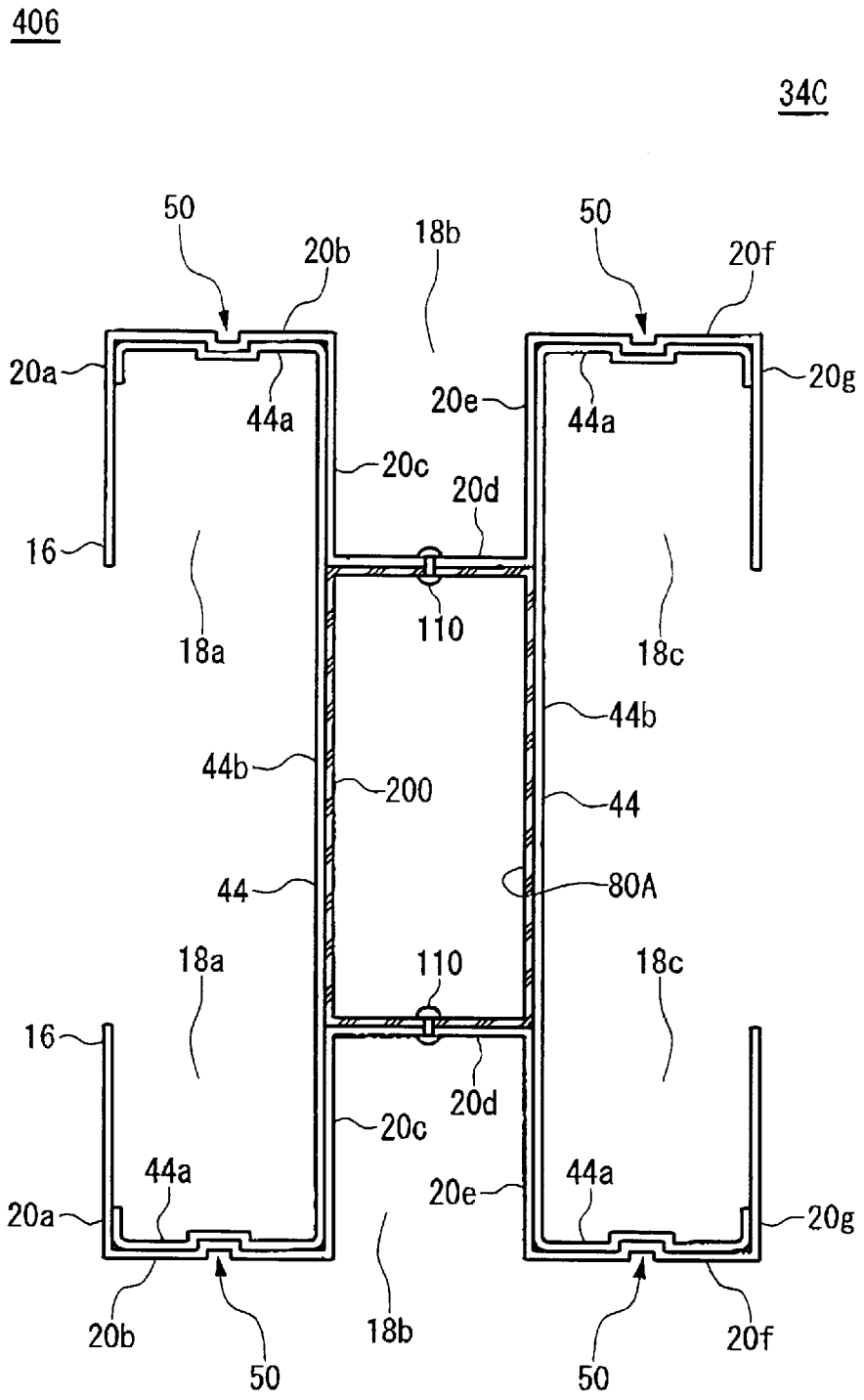

FIG. 23 shows an embodiment of a structural unit when the structural member 34C is used to form the structural unit 402 shown in FIG. 21 and FIG. 22 instead of using the structural member 32A.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
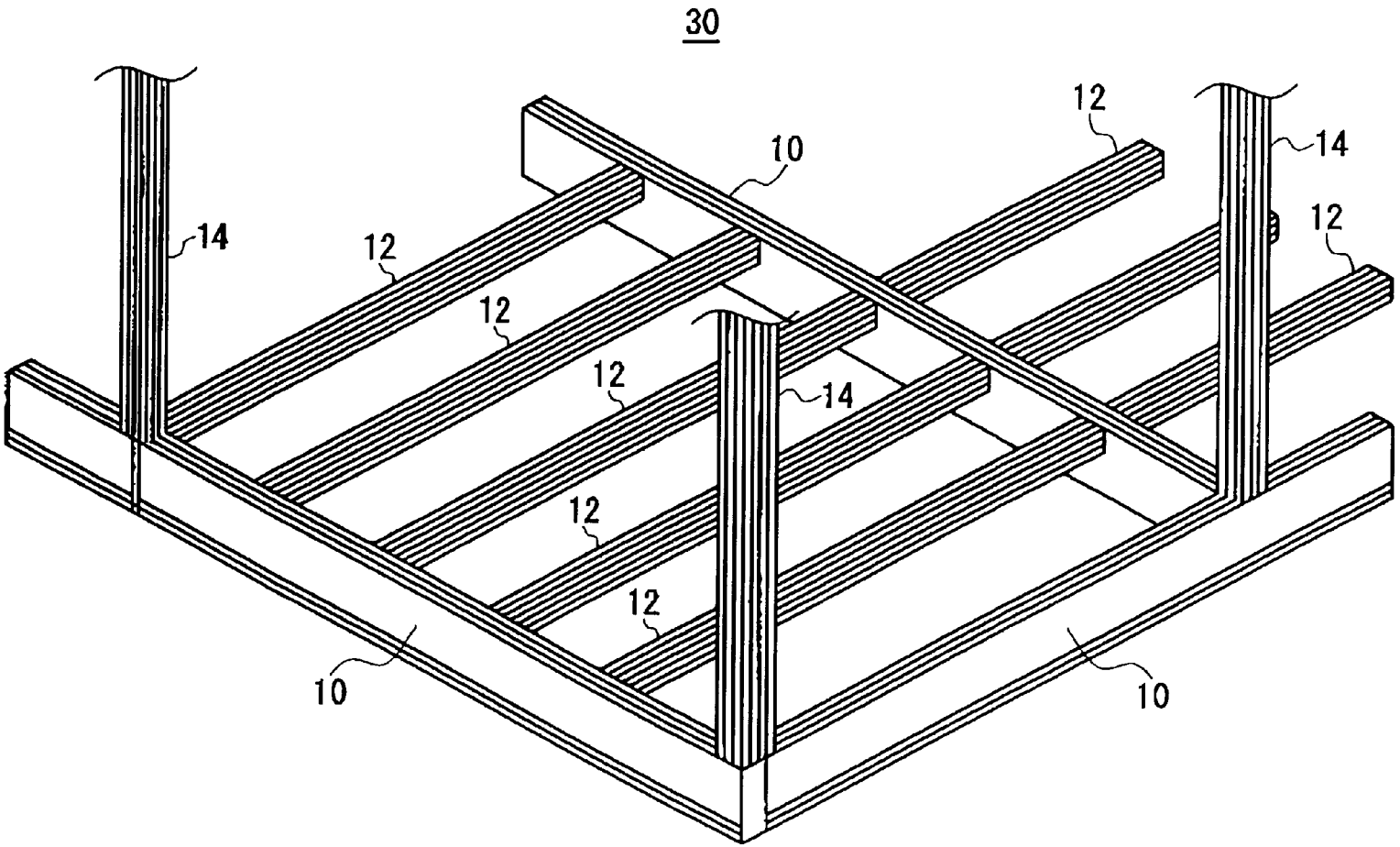
FIG. 1 shows a structural member of an embodiment of the present invention.

FIG. 1 shows an example of a structure constructed using structural members of the present invention. The structure 30 has a plurality of main beams 10, a plurality of straining beams 12, and a plurality of columns 14. The main beams 10 are set substantially horizontally to support the weight of the structure 30 transferred from the columns 14 together with the straining beams 12. The main beams 10 are primarily provided on the periphery of the outside surface of the structure 30. Each of the plurality of the straining beams 12 are arranged substantially perpendicular to the main beams 10, and the straining beams 12 connect the plurality of the main beams 10 with each other.

The columns 14 are provided vertically to the main beams 10, and the columns 14 support the structure 30 by transferring the weight of the structure 30 to the main beams 10. The main beams 10, straining beams 12, and the columns 14 of the present embodiment are constructed using the structural members 32A–32F or 34A–34D of the present embodiments shown from FIG. 2 to FIG. 14. In FIG. 1, only a section of the floor of the structure 30 is shown. However, a plurality of floors can be constructed by repeatedly setting main beams 10 on the upper end of the columns 14 and connecting each of the main beams 10 with each other by the straining beams 12.

Figure 2:
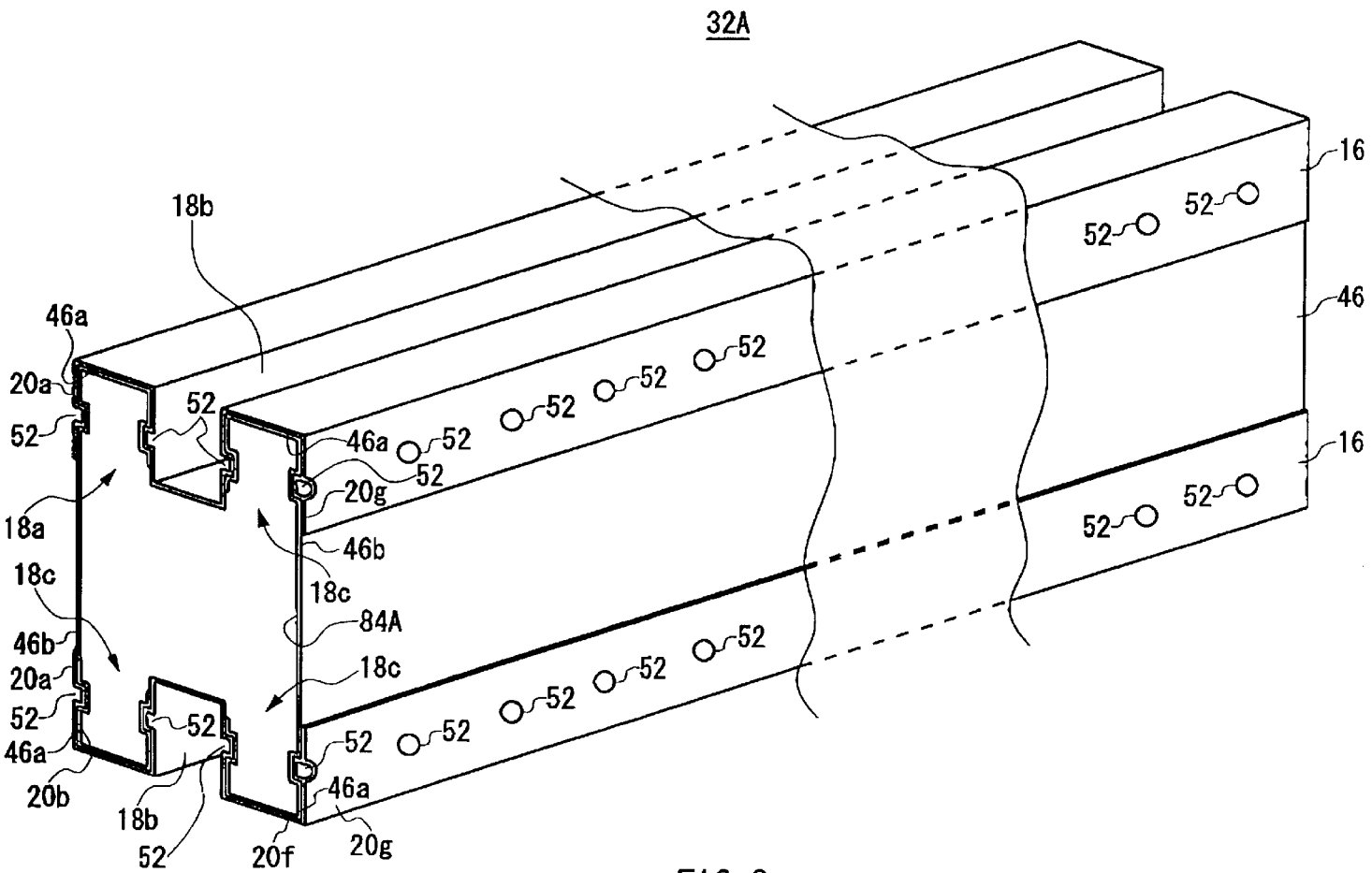
FIG. 2 shows a perspective view of the structural member 32A.
Figure 3:
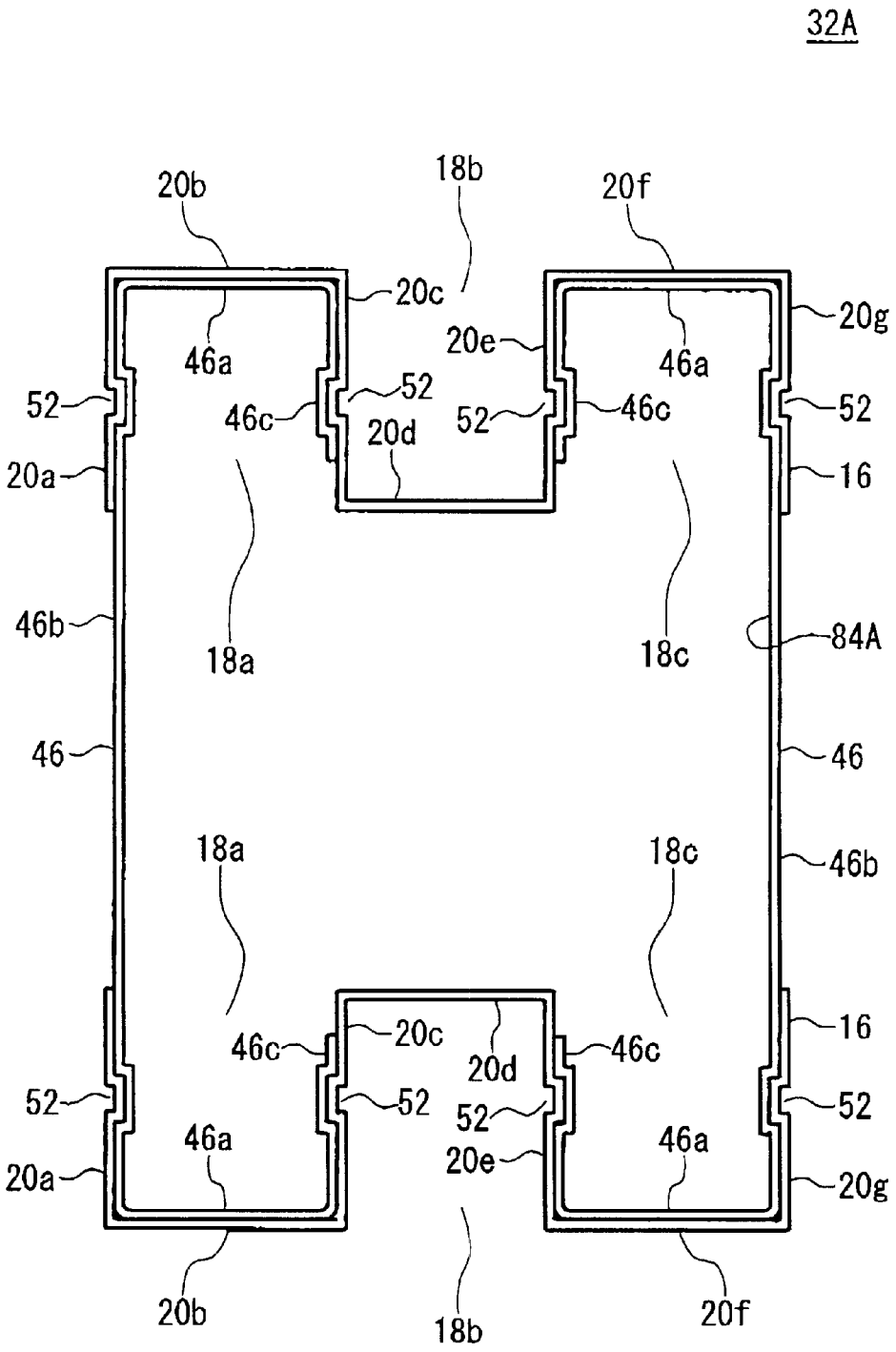
FIG. 3 shows a cross section of the structural member 32A shown in FIG. 2.

FIG. 2 and FIG. 3 show a configuration of a structural member 32A used as a main beam shown in FIG. 1. FIG. 2 shows a perspective view of the structural member 32A. FIG. 3 shows a cross section f the structural member 32A shown in FIG. 2. The structural member 32A has a pair of structural elements 16 and a pair of channel sections 46 as connecting members.

The structural element 16 includes three channels 18*a*, 18*b*, and 18*c*, which alternately open towards opposite directions. The structural element 16 also has a substantially uniform cross section along a longitudinal direction. Furthermore, the structural element 16 includes seven rectangular planar portions 20*a*, 20*b*, 20*c*, 20*d*, 20*e*, 20*f*, and 20*g*, respectively. Each of the neighboring faces of the seven planar portions 20*a*, 20*b*, 20*c*, 20*d*, 20*e*, 20*f*, and 209 are substantially perpendicular to each other. The configuration of the structural element 16 will be described in further detail in FIG. 4.

A pair of structural elements 16 of the structural member 32A shown in FIG. 2 and FIG. 3 are aligned and connected to each other by the pair of channel sections 46, such that each of the side channels 18*a* and 18*c* of the three channels 18*a*, 18*b*, and 18*c* of one of the structural elements 16 face corresponding side channels 18*a* and 18*c* of another structural element 16, respectively.

A pair of channel sections 46 is used as connecting members. Each of the side faces 46*a* of the left side channel section 46 engage with each of the inner faces of the second planar portions 20*b* of the pair of structural elements 16, respectively. The bottom face 46*b* of the left side channel section 46 engages with each of the inner faces of the first planar portions 20*a* of the pair of structural elements 16. Furthermore, each of the side faces 46*a* of the right side channel section 46 engage with each of the inner faces of the sixth planar portions 20*f* of the pair of structural elements 16, respectively. The bottom face 46*b* of the right side channel section 46 engages with each of the inner faces of the seventh planar portions 20*g* of the pair of structural elements 16. A space 84A that has a substantially H-shaped cross section is formed by the pair of channel sections 46 and the pair of structural elements 16.

Therefore, each of the side faces 46*a* of the channel section 46 are contained inside the side channels 18*a* or lac of the pair of structural elements 16 such that the channel section 46 opens towards the inside of the structural member 32A. The widths of the side channels lea or 18*c* are preferably wider than the height of the side face of the channel section 46, in order to contain the side face 46*a* of the channel section 46 inside the side channels 18*a* or 18*c* of the structural element 16. By forming the structural member 32A in an H-shape using the pair of structural elements 16 and the pair of channel sections 46 as shown in FIG. 2 and FIG. 3, the strength of the structural member 32A becomes greater than the strength of the individual structural element 16 and the channel section 46.

After accommodating the side faces 46*a* of the pair of channel sections 46 inside the side channels 18*a* and 18*c* of the pair of structural elements 16, the structural elements 16 and channel sections 46 are connected by forming concave parts 52. The concave parts 52 are formed by driving a punch into the first planar portion 20*a* and the third planar portion 20*c* or fifth planar portion 20*e* and seventh planar portion 20*g* of the structural elements 16 The concave parts can also be formed by sandwiching the first planar portion 20*a* and the third planar portion 20*c* or fifth planar portion 20*e* and seventh planar portion 20*g* of the structural element 16 and the channel section 46 by means such as clinching from the outside of the structural element 16. The structural element 16 and the channel section 46 can also be fixed to each other using a rivet, a drilling screw, a tapping screw, a screw nail, a bolt, or welding.

That is, the first and seventh planar portions 20*a* and 20*g* of each of the pair of structural elements 16 among a part where the structural element 16 and the channel section 46 engages have a concave part 52, which connects the structural element 16 and the channel section 46. Also, the first and seventh planar portions 20*a* and 20*g* of the pair of structural elements 16 among a part where the structural element 16 and the channel section 46 engages may have a rivet, a drilling screw, a tapping screw, a screw nail, a bolt, or welding part, which connects the structural element and the connecting member.

Because the structural member 32A is made to have an H-shaped cross-section, the structural member 32A has a high compressive strength when the load is applied in the longitudinal direction of the structural member 32A. The structural member 32A also has a high bending strength when the load is applied vertically to the longitudinal direction of the structural member 32A. Therefore, it is preferable to use structural member 32A for a main beam 10 of the structure 30. Furthermore, the structural member 32A can be used for a column 14 because the compressive strength of the structural member 32A is high.

Figure 4:
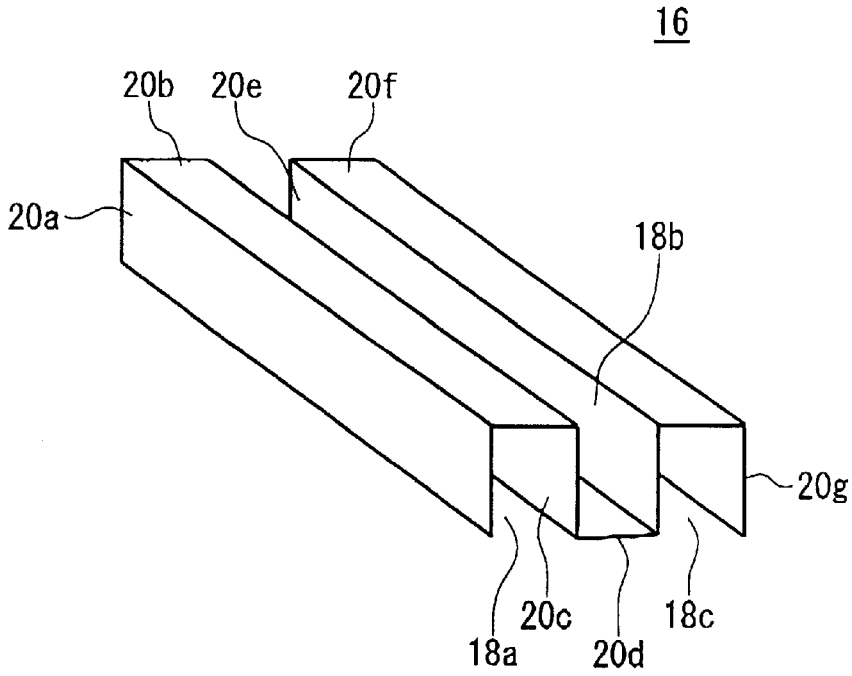
FIG. 4 shows a detailed configuration of the structural element 16 shown in FIG. 2 and FIG. 3.

FIG. 4 shows a detailed configuration of the structural element 16 shown in FIG. 2 and FIG. 3 The structural element 16 includes three channels 18*a*, 18*b*, and 18*c*, the opening direction of which changes alternately in the opposite direction. The structural element 16 also has a substantially uniform cross section along a longitudinal direction. Here, each side channel of the three channels is shown by the reference 18*a* and 18*c*, and the central channel of the three channels is shown by the reference 18*b*.

Each of the three channels 18*a*, 18*b*, and 18*c* of the structural element 16 are substantially rectangular. Each of the widths and heights of the three channels 18*a*, 18*b*, and 18*c* of the structural element 16 are substantially equal. Therefore, the structural element 16 includes a first planar portion 20*a*, a second planar portion 20*b*, a third planar portion 20*c*, a fourth planar portion 20*d*, a fifth planar portion 20*e*, a sixth planar portion 20*f*, and a seventh planar portion 20*g*, the shapes of which are substantially rectangular as shown in FIG. 2 and FIG. 3. The height and width of the three channels 18*a*, 18*b*, and 18*c* of the structural element 16 can be different. For example, the height of the central channel lab can be higher than the height of both of the side channels 18*a* and 18*c*.

Each of the first, third, fifth, and seventh planar portions 20*a*, 20*c*, 20*e*, and 20*g* are spaced at a predetermined interval with each other and are arranged substantially parallel to each other. The second and sixth planar portions 20*b* and 20*f* are substantially aligned in one line. The fourth planar portion 20*d* is arranged parallel to the second and sixth planar portions 20*b* and 20*f*. The fourth planar portion 20*d* is spaced from the second and sixth planar portions 20*b* and 20*f* by the height of the first, third, fifth, and seventh planar portions 20*a*, 20*c*, 20*e*, and 20*g*.

Because the structural element 16 has first, third, fifth, and seventh planar portions 20*a*, 20*c*, 20*e*, and 20*g* arranged parallel to each other, the structural element 16 has larger compressive strength and bending strength compared to a channel section if the structural element 16 has a same thickness as the thickness of the channel section.

For example, if the thickness of the structural element 16 is 1 mm and the height of the first, third, fifth, and seventh planar portions 20*a*, 20*c*, 20*e*, and 20*g* are 30 mm, and the width of the second and sixth planar portions 20*b* and 20*f* are 30 mm and the width of the fourth planar portion 20*d* is 25 mm, the compressive strength in the longitudinal direction of the structural element 16 becomes substantially 20 kN.

On the other hand, if the thickness of the channel section is 1 mm, and the heights of the side faces are 50 mm, and the width of the base face is 100 mm, the compressive strength in the longitudinal direction is substantially 10 kN. Therefore, the compressive strength of he structural element 16 in the longitudinal direction is approximately two times more than that of the channel section when the structural element 16 has a same thickness of the channel section.

Furthermore, when the structural element 16 is set horizontally such that both side channels 18*a* and 18*c* face upwards, and force is applied downwards onto the structural element 16, the structural element 16 has a strength approximately two and half times greater compared to the channel section when the structural element 16 has a same thickness of the channel section.

For example, if a load is applied on the structural element 16 having an above-mentioned size downwards onto the structural element 16, the structural element 16 has a bending strength of substantially 5 kN. On the other hand, if the load is applied on the channel section having an above mentioned size downwards onto the channel section, the channel section has a bending strength of substantially 2 kN Therefore, making the thickness of the structural element 16 as thin as possible, whilst maintaining the necessary strength can reduce the weight of the structural element 16.

The structural element 16 is manufactured from a metal plate such as a steel plate or an aluminum plate. A high-tensile steel having a tensile strength more than 500 N/mm$^2$ may be used as a material of the structural element 16. For example, the structural element 16 is manufactured by bending a steel plate using, for example, presswork. By forming the structural element 16 in the form as shown in FIG. 2, the thickness of the structural element 16 can be reduced while maintaining the necessary strength for the structural element 16. For example, the thickness of the structural element 16 may be formed substantially from 0.5 mm to 1.5 mm.

Figure 5:
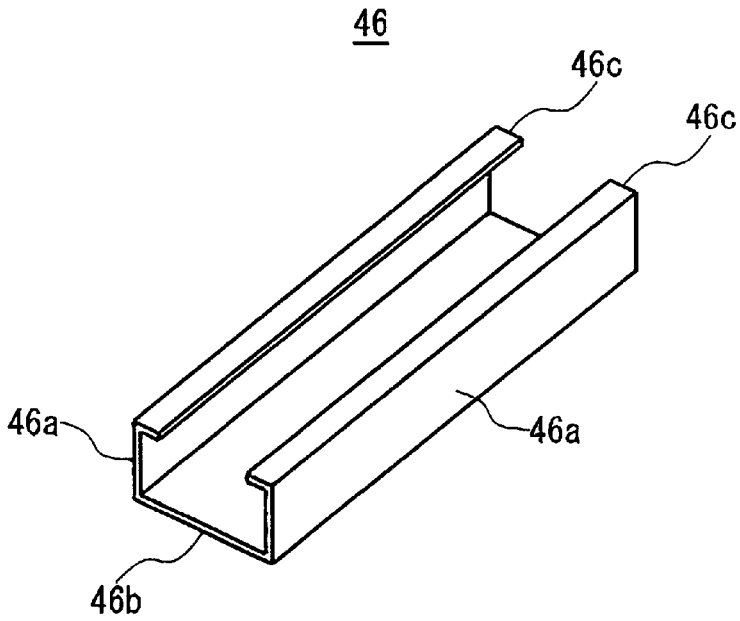
FIG. 5 shows a perspective view of the channel section 46

FIG. 5 shows a perspective view of the channel section 46. The channel section 46 has one bottom face 46*b* and two side faces 46*a*. The side faces 46*a* are provided on both ends of the bottom face 46*b* such that the side faces 46*a* stand substantially vertical to the bottom face 46*b*. An overhanging part 46*c* is provided on each end of the side faces 46*a* such that the overhanging part 46*c* extends perpendicular to the side face 46*a* and parallel to the bottom face 46*b*.

Figure 6:
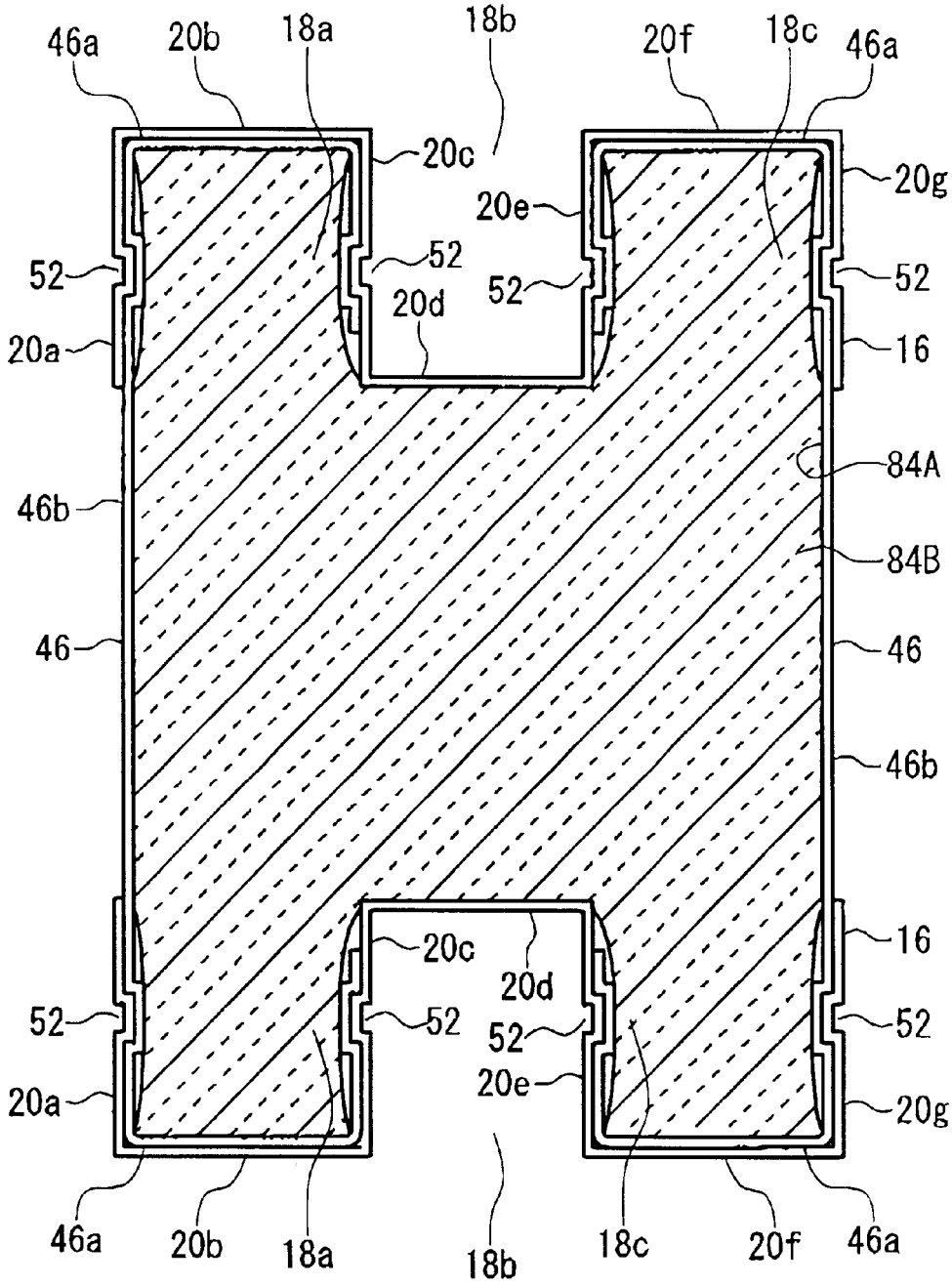
FIG. 6 shows another embodiment of the structural member.

FIG. 6 shows another embodiment of the structural member. The structural member 42B has a filling member 84B in the H-shaped space 84A. The configuration is the same as the configuration of the structural member 32A of FIG. 3, and thus the explanations of which are abbreviated. The filling member 84B, which is substantially the same shape with the space 84A, fills substantially the entire inside space 84A of the structural member 32B. A heat insulating material such as expanded polystyrene, which has a heat insulating property and a sound insulating property, can be used as a filling member 84B.

By providing the filling member 84B with a heat insulating property inside the space 84A, the structural member 32B has a heat insulating property so that condensation inside a structure 30 can be reduced. Furthermore, by inserting the tilling member 84B that has a sound insulating property inside the space 84A, the noise inside the structure 30 and the noise from outside the structure 30 such as traffic noise can be reduced.

Because the structural member 32B is formed to have an H-shaped cross-section, the structural member 32B has a high compressive strength when a force is applied in the longitudinal direction of the structural member 32B. Furthermore, because the filling member 84B contacts substantially all of the inside faces of the structural member 32A to support the structural member 32A, the filling member 84B supplies a force that can resist the force that deforms the structural member 32A. Therefore, the compressive strength in the longitudinal direction of the structural member 32B and the bending strength when the force is applied vertically to the longitudinal direction of the structural member 32B further increases.

Therefore, it is preferable to use the structural member 329 for a main beam 10 of the structure 30. Furthermore, the structural member 32B can be used for a column 14 because the compressive strength of the structural member 32B is high.

Figure 7:
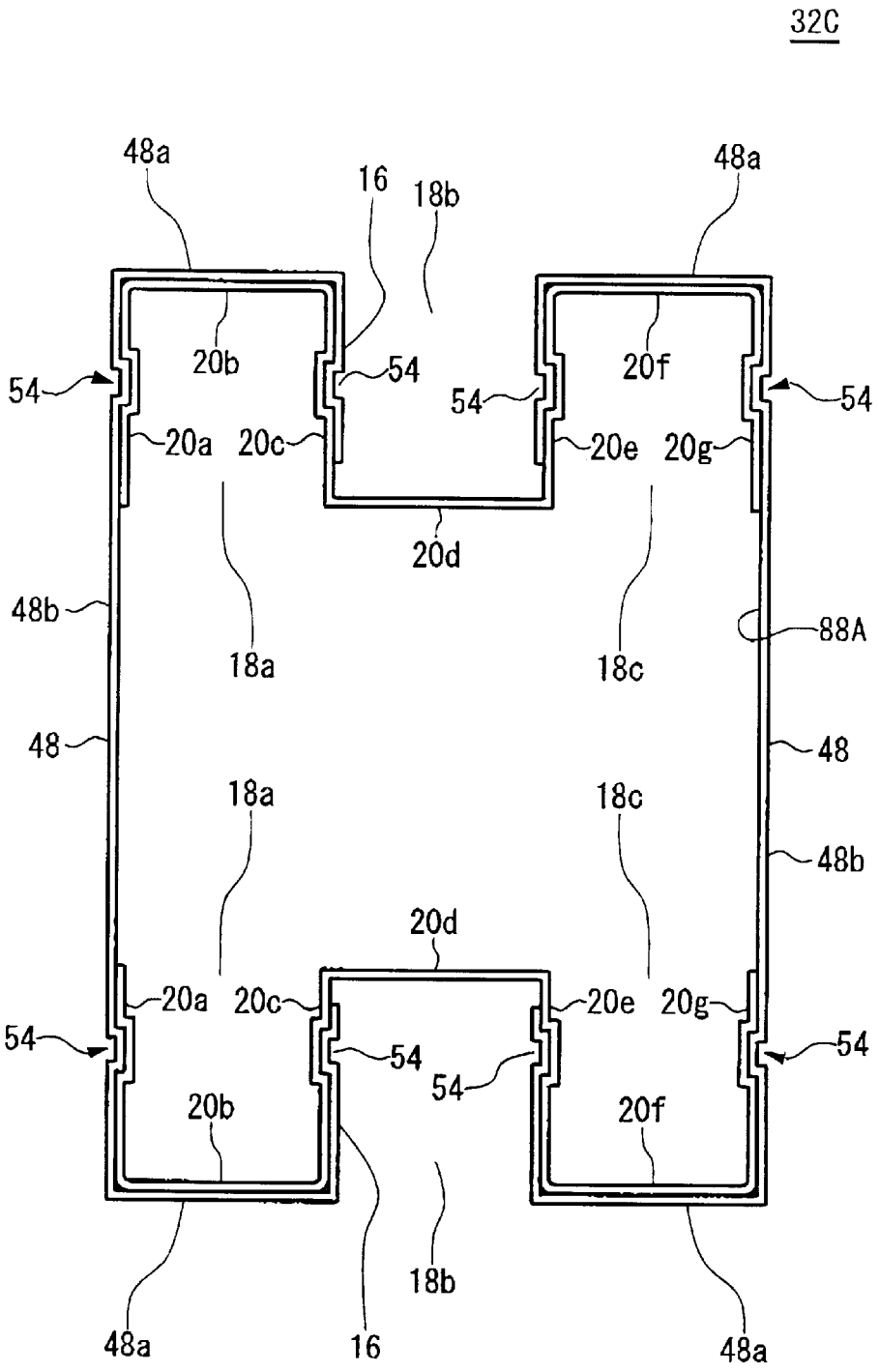
FIG. 7 shows another further embodiment of a structural ember adapted to be used for a main beam 10.

FIG. 7 shows another further embodiment of a structural member adapted to be used for a main beam 10. Similar to the structural member 32A shown in FIG. 3, a pair of structural elements 16 of the structural member 32C shown in FIG. 7 are aligned and connected to each other by a pair of channel sections 48 such that each of the side channels 18*a* and 18*c* of the three channels 18*a*, 18*b*, and 18*c* of one of the structural elements 16 face the corresponding side channels 18*a* and 18*c* of another structural element 16

A pair of channel sections 48 is used as connecting members. The difference between the structural member 32A of FIG. 3 and the structural member 32C of FIG. 7 is in the arrangement between the channel section 46 or 48 and the structural element 16. The structural member 32A of FIG. 3 contains the side face 46*a* of the channel section 46 inside the side channel 18*a* or lac of the structural element 16. On the other hand, the structural member 32C of FIG. 7 contains the first, second, third, fifth, sixth, and seventh planar portions 20*a*, 20*b*, 20*c*, 20*e*, 20*f*, and 20*g*, which constitute the side channel 18*a* or 18*c* of the structural element 16, inside the channel section 48.

For example, each of the side faces 48*a* of the left side channel section 48 engages with each outer face of the second planar portions 20*b* of the structural elements 16. Furthermore, the bottom face 48*b* of the left side channel section 46 engages with the outer face of each of the first planar portions 20*a* of each of the pair of structural elements 16.

Moreover, each of the side faces 48*a* of the right side channel section 46 engages with the outer face of each of the sixth planar portions 20*f* of the pair of structural elements 16. Furthermore, the bottom face 48*b* of the right side channel section 48 engages with the outer face of each of the seventh planar portions 20*g* of the pair of structural elements 16. Therefore, each of the channel sections 48 contain the side channels 18*a* or lac of the structural element 16 such that the channel section 48 opens towards the inside of the structural member 32C.

Therefore, two side faces 48*a* of one of the channel section 46 of the pair of channel sections 48 engage with the outer faces of the second planar portions 20*b* of each of the pair of structural elements 16. A bottom face 46*b* of one of the channel sections 48 of the pair of channel sections 48 engages with the outer faces of each of the first planar portions 20*a* of the pair of structural elements 16.

Moreover, two side faces 48*a* of another channel section 48 of the two channel sections 46 engage with the outer faces of the sixth planar portions 20*f* of each of the pair of structural elements 16. A bottom face 48*b* of another channel section 48 of the pair of channel sections 48 engages with the outer faces of each of the seventh planar portions 20*g* of the pair of structural elements 16. A space 88A that has a substantially H-shaped cross section is formed by the pair of channel sections 48 and the pair of structural elements 16.

After accommodating the side channels 18*a* and 18*c* of the structural element 16 into the side faces 48*a* of the channel sections 48, the structural element 16 and the channel section 48 are connected by forming concave parts 54 The concave parts 54 are formed by driving a punch into the first and third planar portions 20*a* and 20*c* or fifth and seventh planar portions 20*e* and 20*g* of the structural elements 16.

The concave parts 54 can be also formed by sandwiching the first and third planar portions 20*a* and 20*c* or fifth and seventh planar portions 20*e* and 20*g* of the structural elements 16 by means such as clinching from the outside of the channel section 48. The structural element 16 and the channel section 48 can be fixed to each other by means such as a rivet, a drilling screw, a tapping screw, a screw nail, a bolt, or welding.

That is, the first and seventh planar portions 20*a* and 20*g* of each of the pair of structural elements 16 among a part where the structural element 16 and the channel section 48 engages have a concave part 54, which connects the structural element 16 and the channel section 48.

Because the structural member 32C is formed to have an H-shaped cross-section, the structural member 32C has high compressive strength when the load is applied in the longitudinal direction of the structural member 32C. The structural member 32C also has high bending strength when the load is applied vertically onto the longitudinal direction of the structural member 32C Therefore, it is preferable to use a structural member 32C for a main beam 10 of the structure 30. Furthermore, the structural member 32C can be used for a column 14 because the compressive strength of the structural member 32C is high.

Figure 8:
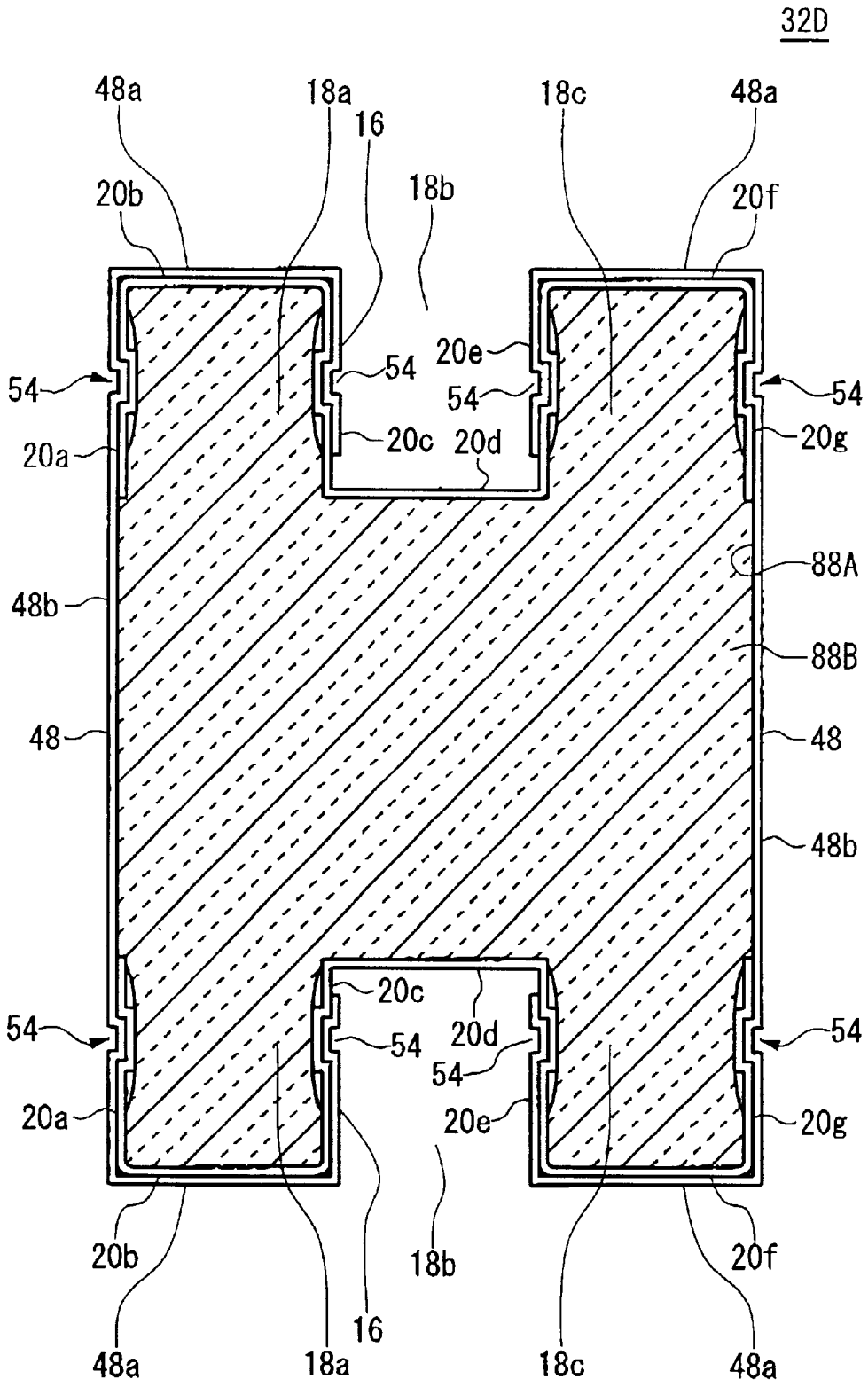
FIG. 8 shows another embodiment of the structural member.

FIG. 8 shows another embodiment of the structural member. The structural member 32D has a filling member 88B in the H-shaped space 88A. The configuration is the same as the configuration of the structural member 32C shown in FIG. 7, and thus the explanations of which are abbreviated. The filling member 88B, which is substantially the same shape as the space 86A, fills substantially the entire space 88A inside the structural member 32D. A heat insulating material such as expanded polystyrene can be used as a filling member 88B.

By providing the filling member 88B with a heat insulating property inside the space 88A, the structural member 32D has a heat insulating property so that condensation inside a structure 30 can be reduced. Furthermore, by providing the filling member 88B, which has a sound insulating property inside the space 88A, the noise inside the structure 30 and the noise from outside the structure 30 such as traffic noise can be reduced.

Because the structural member 32D is formed to have an H-shaped cross-section, the structural member 32D has a high compressive strength when a force is applied in the longitudinal direction of the structural member 32D. Furthermore, because the filling member 88B contacts substantially all of the inside faces of the structural member 32A to support the structural member 32D, the filling member 88B supplies a force that can resist the force that deforms the structural member 32D. Therefore, the compressive strength in the longitudinal direction of the structural member 32D and the bending strength when the force is applied vertically to the longitudinal direction of the structural member 32D further increases.

Therefore, it is preferable to use structural member 32D for a main beam 10 of the structure 30. Furthermore, the structural member 32D can be used for a column 14 because the compressive strength of the structural member 32D is high.

Figure 9:
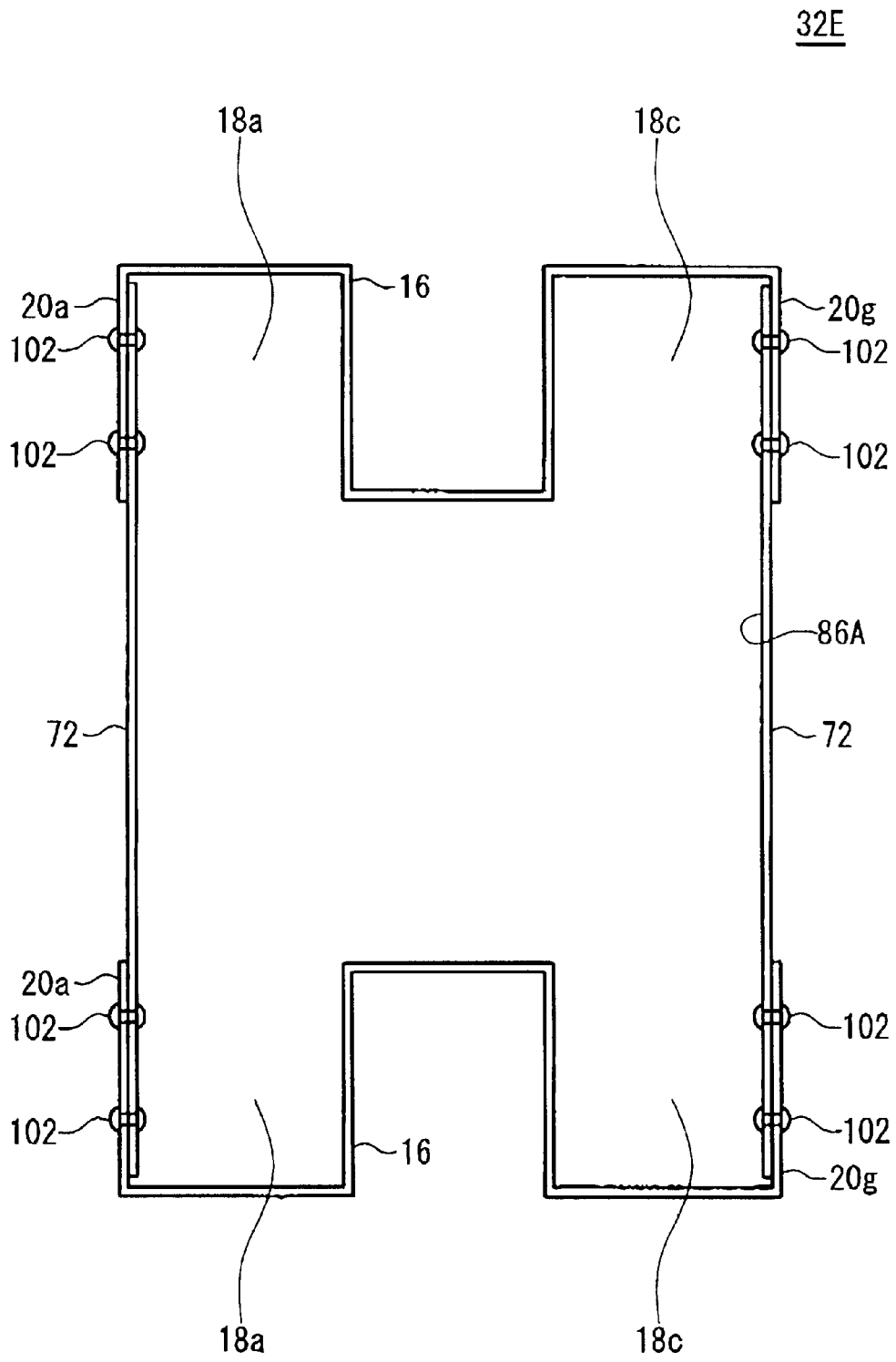
FIG. 9 shows another embodiment of the structural member.

FIG. 9 shows another embodiment of a structural member. Similar to the structural member 32A shown in FIG. 3, pair of structural elements 16 of the structural member 32E shown in FIG. 9 are aligned and connected to each other by the steel plates 72 such that each of the side channels 18*a* and 18*c* of one of the structural elements 16 face corresponding side channels 18*a* and 18*c* of another structural element 16. The structural member 32E shown in FIG. 9 has pair of steel plates 72 that have a substantially rectangular plan shape as a connecting member. The pair of structural elements 16 is connected by pair of steel plates 72.

One of the two steel plates 72 engages with the inner face of the first planar portion 20*a* of each of the pair of structural elements 16; and the other steel plate 72 engages with the inner face of the seventh planar portion 20*g* of each of the pair of structural elements 16; and a space 86A having a substantially H-shaped cross section is formed by the pair of steel plates 72 and the pair of structural elements 16.

In FIG. 9, the first and seventh planar portions 20*a* and 20*g* of the structural elements 16 and the corresponding steel plates 72 are connected by the rivets 102. The first and seventh planar portions 20*a* and 20*g* of the structural elements 16 and the corresponding steel plates 72 may be connected by means such as a drilling screw, a tapping screw, a screw nail, a bolt or welding.

Because the structural member 32E is formed to have an H-shaped cross-section, the structural member 32E has high compressive strength when the load is applied in the longitudinal direction of the structural member 32E. The structural member 32E also has high bending strength when the load is applied vertically to the longitudinal direction of the structural member 32E. Therefore, it is preferable to use the structural member 32E for a main beam 10 of the structure 30. Furthermore, the structural member 32E can be used for a column 14 because the compressive strength of the structural member 32E is high.

Figure 10:
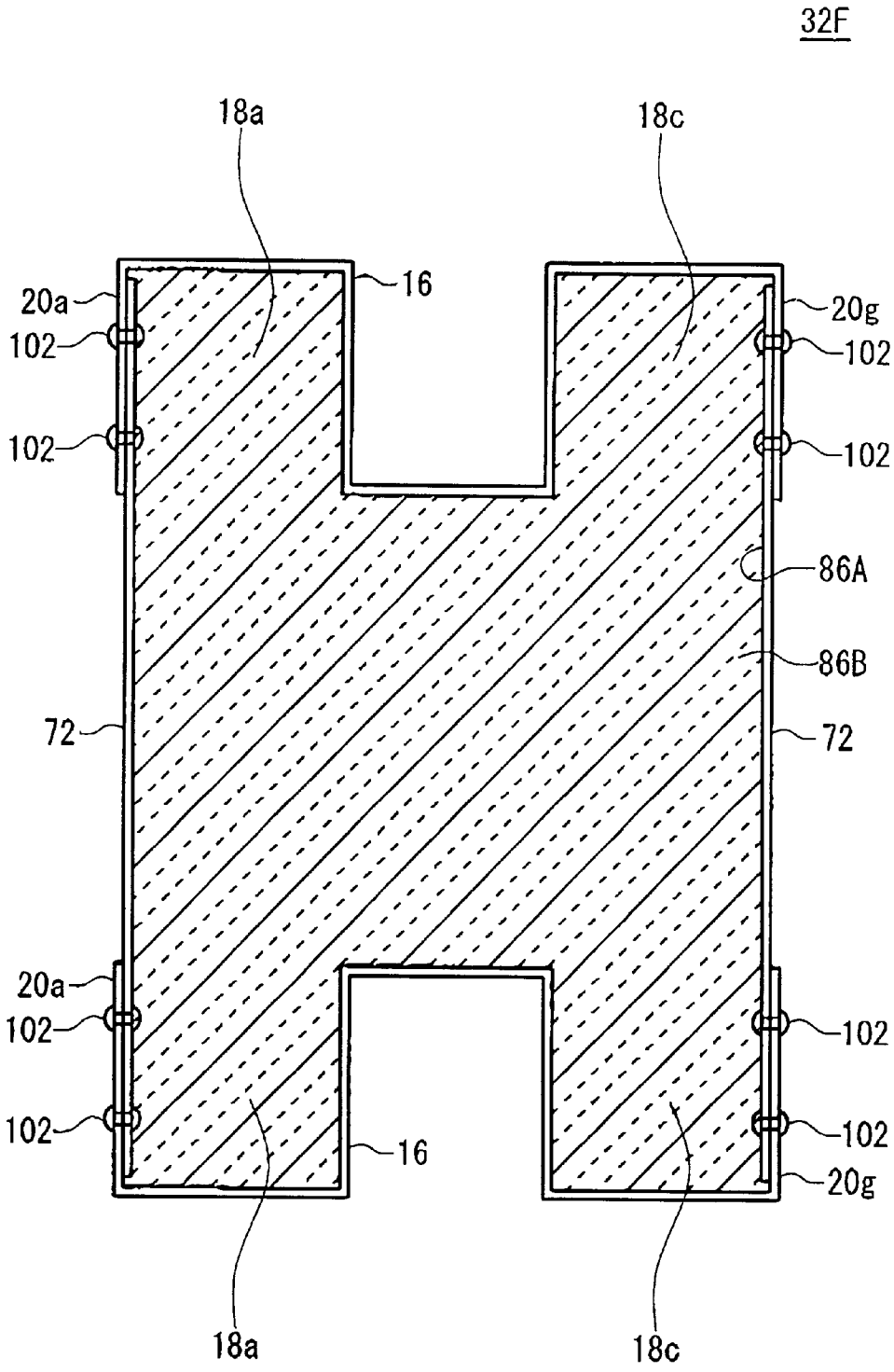
FIG. 10 shows another embodiment of the structural member.

FIG. 10 shows another embodiment of the structural member. The structural member 32F has a filling member 86B in the H-shaped space 86A. The configuration is the same as the configuration of the structural member 32E of FIG. 9, and thus the explanations of which are abbreviated. The filling member 86B, which is substantially the same shape as the space 86A, fills substantially the entire space 86A inside the structural member 32E. A heat insulating material such as expanded polystyrene can be used as a filling member 86B.

By providing the filling member 86B that has a heat insulating property inside the space 86A, the structural member 32F has a heat insulating property so that the condensation inside a structure 30 can be reduced. Furthermore, by providing the filling member 86B that has a sound insulating property inside the space 86A, the noise inside the structure 30 and the noise from outside the structure 30 such as traffic noise can be reduced.

Because the structural member 32F is made to have an H-shaped cross-section, the structural member 32F has high compressive strength when a force is applied in the longitudinal direction of the structural member 32F. Furthermore, because the filling member 86B contacts substantially all of the inside faces of the structural member 32F to support the structural member 32F, the filling member 86B supplies a force that can resist the force which deforms the structural member 32F. Therefore, the compressive strength in the longitudinal direction of the structural member 32F and the bending strength when the force is applied vertically to the longitudinal direction of the structural member 32F further increases.

Therefore, it is preferable to use a structural member 32F for a main beam 10 of the structure 30. Furthermore, the structural member 32F can be used for a column 14 because the compressive strength of the structural member 32F is high.

Figure 11:
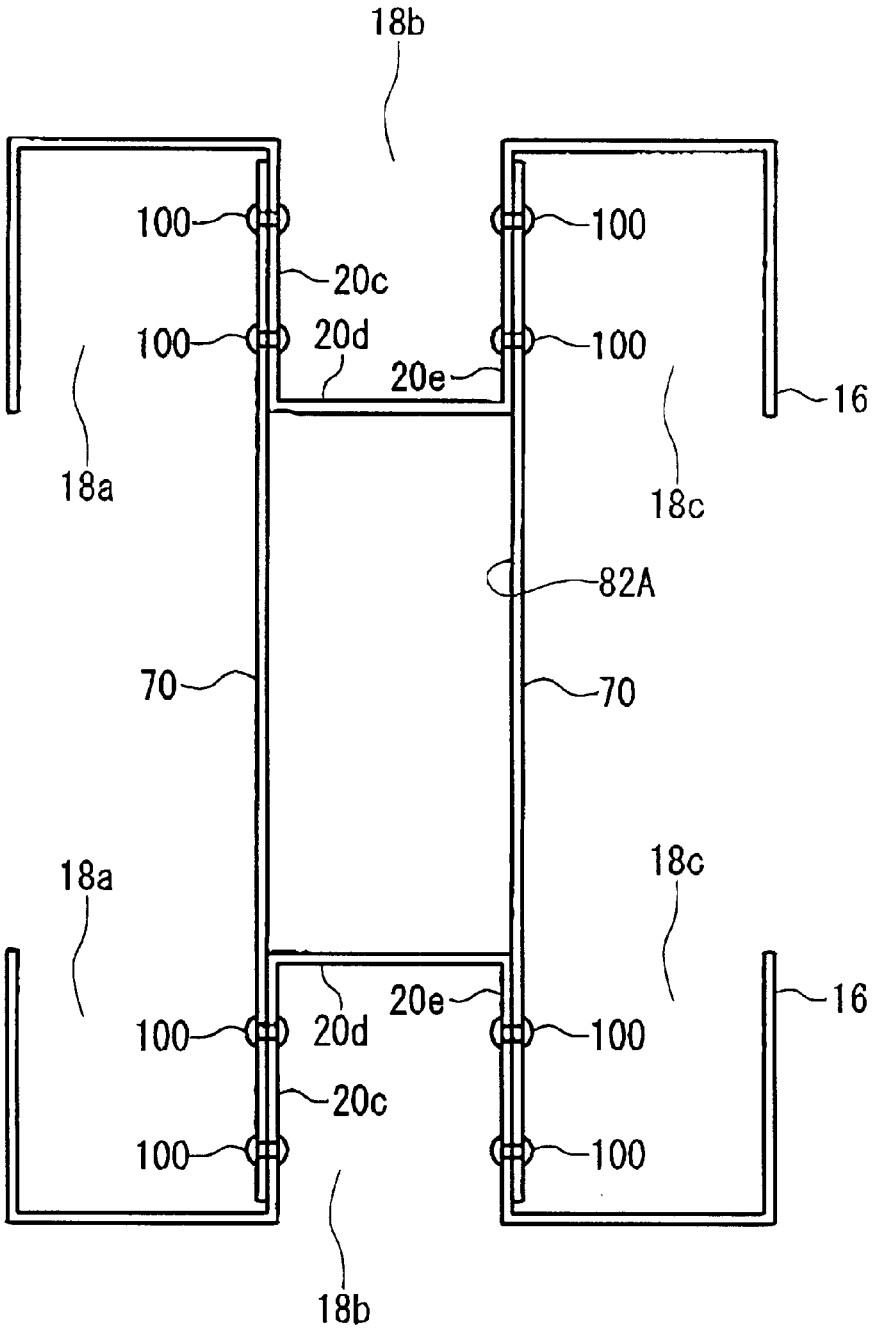
FIG. 11 shows another embodiment of the structural member.

FIG. 11 shows another embodiment of a structural member. A pair of structural elements 16 of the structural member 34A shown 20 in FIG. 11 are aligned and connected to each other by a pair of steel plates 70 such that each of the side channels 18*a* and 18*c* of one of the structural elements 16 faces corresponding side channels 18*a* and 18*c* of another structural element 16.

The structural member 34A shown in FIG. 11 includes a steel plate 70 that has a substantially rectangular plan shape as a connecting member. For example, the left side steel plate 70 engages with the third planar portion 20*c* of each of the pair of structural elements 16. Furthermore, the right side steel plate 70 engages with the fifth planar portion 20*e* of each of the pair of structural elements 16. A space that has a substantially rectangular cross section is formed by the pair of steel plates 70 and each fourth planar portion 20*d* of the pair of structural elements 16.

The third and fifth planar portions 20*c* and 20*e* of the structural element 16 and the corresponding steel plates 70 are connected by the rivets 100. However, the third and fifth planar portions 20*c* and 20*e* of the structural element 16 and the corresponding steel plates 70 can be fixed by means such as a drilling screw, a tapping screw, a screw nail, a bolt, or welding.

Because the structural member 34A has a channel 18*a* and 18*c* that opens to the outside, the structural member 34A is easily connected or combined with the other structural members.

Figure 12A:
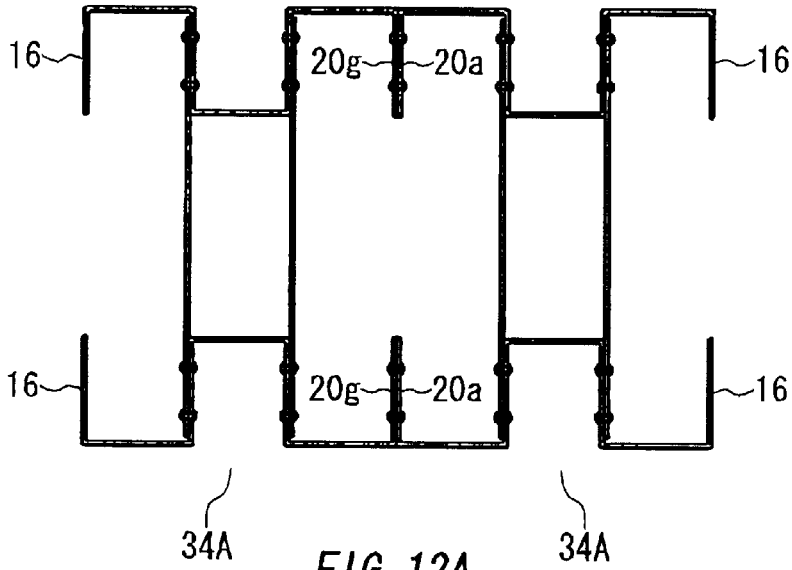
FIGS. 12A and 12B show examples of combining a plurality of structural members 34A.

FIGS. 12A and 12D show an example of combining a plurality of structural members 34A. In FIG. 12A, two structural members 34A are connected to each other laterally such that the seventh planar portion 20*g* of each structural element 16 of the left side structural member 34C are connected to the corresponding first planar portion 20*a* of each structural element 16 of another structural member 32. The structural members 34A can be connected to each other by means such as a drilling screw, a tapping screw, a screw nail, a bolt, or welding.

Figure 12B:
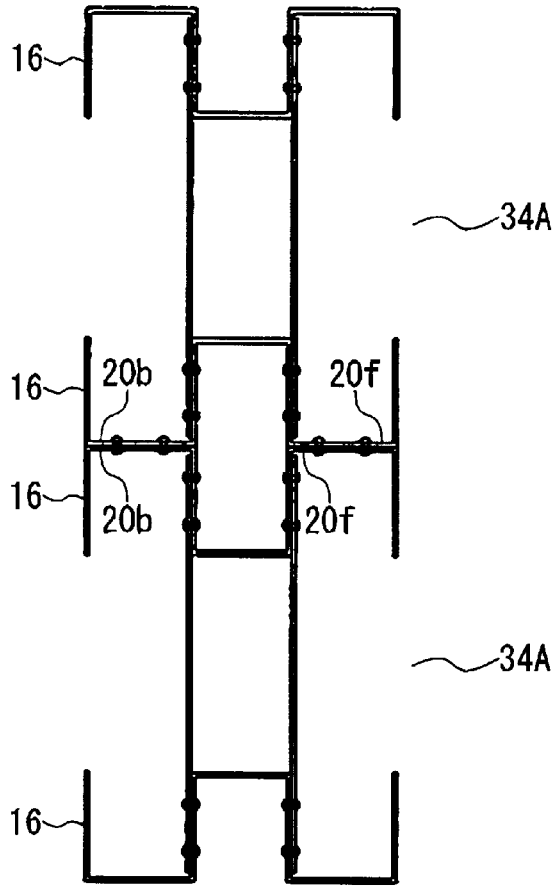

Moreover, in FIG. 12B, two structural members 34A are connected to each other vertically such that the second and sixth planar portions 20*b* and 20*f* of the lower structural element 16 of the upper structural member 34A are connected to the corresponding second and sixth planar portions 20*b* and 20*f* of the upper structural element 16 of the lower structural member 22A. The plurality of structural members 34A can be connected to each other by means such as a drilling screw, a tapping screw, a screw nail, a bolt, or welding. The structural member 32A can also be connected to other types of structural members 32A–32F or 34B–34D shown from FIG. 2 to FIG. 15 in a manner shown in FIG. 12A and FIG. 12B.

Furthermore, because the structural elements 16 and the steel plates 70 are combined in a form as structural member 34A, a compressive strength and a bending strength of the structural member 32A increases. Therefore, it is preferable to use structural member 34A for a straining beam 12 or a column 14 of the structure 30, which is a member to be connected and combined with the other structural members.

Figure 13:
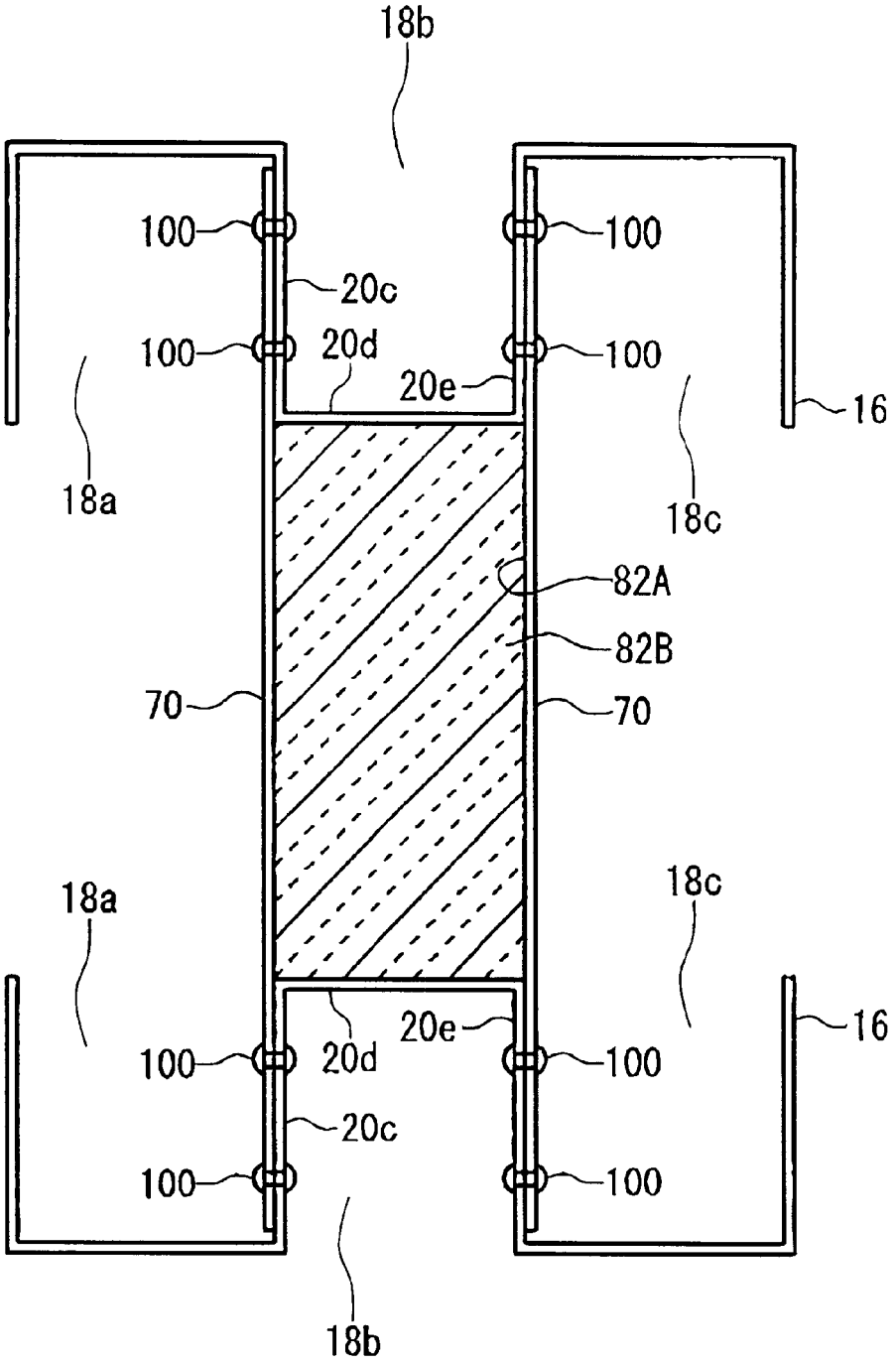
FIG. 13 shows another embodiment of the structural member.

FIG. 13 shows another embodiment of the structural member. The structural member 34B has a filling member 82B, which has substantially the same shape as the shape of the space 82A, in the rectangular-shaped space 82A. The configuration is the same as the configuration of the structural member 34A of FIG. 11, and thus the explanations of which are abbreviated. The filling member 82B, which is substantially the same shape with the space 82A, fills substantially the entire space 62A inside the structural member 34B. A heat insulating material such as expanded polystyrene can be used as a filling member 82B.

By providing the filling member 82B that has a heat insulating property inside the space 82A, the structural member 34B has a heat insulating property so that condensation inside a structure 30 can be reduced. Furthermore, by providing the filling member 82B, which has a sound insulating property inside the space 82A, the noise inside the structure 30 and the noise from outside the structure 30 such as traffic noise can be reduced.

Furthermore, because the filling member 82B contacts substantially all of the inside faces of the space 82A to support the structural member 34B, the filling member 82B supplies a force that can resist the force which deforms the structural member 34B. Therefore, the compressive strength in the longitudinal direction of the structural member 34B and the bending strength when the force is applied vertically to the longitudinal direction of the structural member 34o further increases.

Similar to the structural member 34A, because the structural member 34B has a channel 18*a* and 18*c* that opens to the outside, the structural member 34B can be easily combined with the other structural members as explained in FIG. 12A and 12B Therefore, it is preferable to use structural member 34B for a straining beam 12 or a column 14 of the structure 30, which is a member to be connected and combined with other members.

Figure 14:
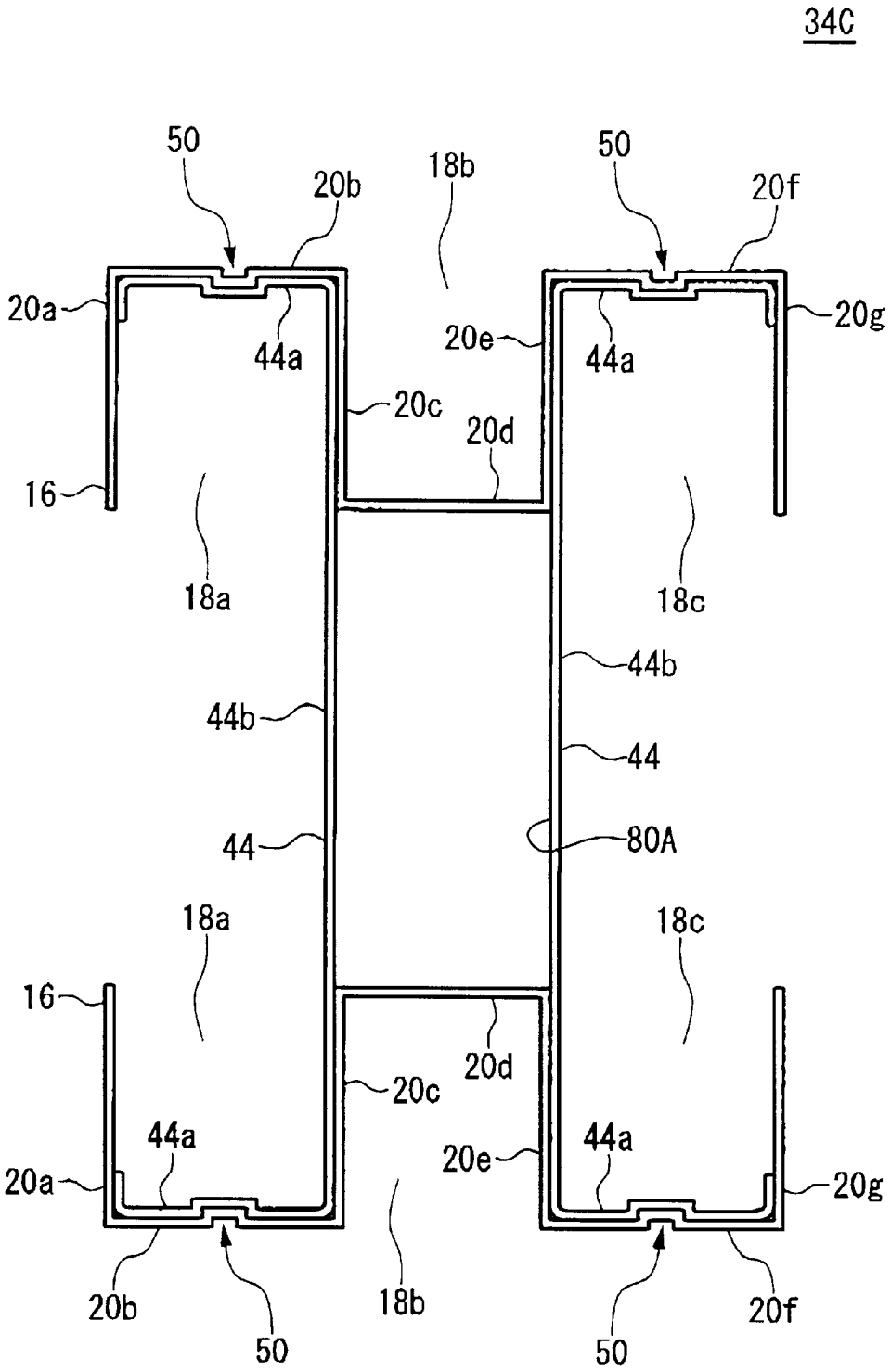
FIG. 14 shows another further embodiment of the structural member.

FIG. 14 shows another further embodiment of the structural member. A pair of channel sections 44 is used as connecting members. Each of the side faces 44*a* of the left side channel section 44 are connected to each of the second planar portions 20*b* of each of the structural elements 16. The bottom face 44*b* of the left side channel section 44 engages with each of the third planar portions 20*c* of the pair of structural elements 16

On the other hand, each of the side faces 44*a* of the right side channel section 44 are connected to each of the sixth planar portions 20*f* of each of the pair of structural elements 16. The bottom face 44*b* of the right side channel section 44 engages with each of the fifth planar portions 20*e* of the pair of structural elements 16. A space 80A that has a substantially rectangular cross section is formed by each of the bottom faces 44*b* of the pair of the channel sections 44 and each of the fourth planar portions 20*d* of the pair of the structural elements 16.

That is, two side faces 44*a* of one of the channel sections 44 of the pair of channel sections 44 engages with the inner face of the second planar portions 20*b* of each of the pair of structural elements 16; and two side faces 44*a* of another channel section 44 of the pair of channel sections 44 engages with the inner face of the sixth planar portions 20*f* of each of the pair of structural elements 16.

Moreover, a bottom face 44*b* of one of the channel sections 44 of the pair of channel sections 44 engages with each of the third planar portions 20*c* of the pair of structural elements 16; and a bottom face 44*b* of another channel section 44 of the pair of channel sections 44 engages with each of the fifth planar portions 20*e* of the pair of structural elements 16; and a space 80A having a substantially rectangular cross section is formed by the pair of channel sections 44 and the pair of structural elements 16.

Therefore, a pair of channel sections 44 are contained inside each of the side channels la and 18*c* of each of the pair of structural elements 16 such that the pair of channel sections 5 44 open towards the outside. After accommodating each of the side faces 44*a* of the channel section 44 into each inside area of the side channels 18*a* and 18*c* of the structural element 16, the structural element 16 and the channel section 44 are connected by forming concave parts 50. The concave parts 50 are formed by driving a punch into the second and sixth planar portions 20*b* and 20*f* of the structural elements 16 or sandwiching the side faces 44*a* of the channel section 44 and the second or sixth planar portions 20*b* or 20*f* of the structural element 16 by means such as clinching from the outside of the structural element 1615

The structural element 16 and the channel section 44 can be fixed to each other using a rivet, a drilling screw, a tapping screw, a screw nail, a bolt, or welding. By using the channel section 44 that has a desired width, the space provided between the pair of structural elements 16 can be arranged to the desired spacing, and thus the height of the structural member 34C can be adjusted to the desired height.

Because the structural member 34C has channels 18*a* and 18*c* that open to the outside, the structural member 34C can be easily combined with the other structural member as explained in FIGS. 12A and 12D. Therefore, it is preferable to use structural member 34A for a straining beam 12 or a column 14 of the structure 30, which is a member to be connected and combined with other members.

Figure 15:
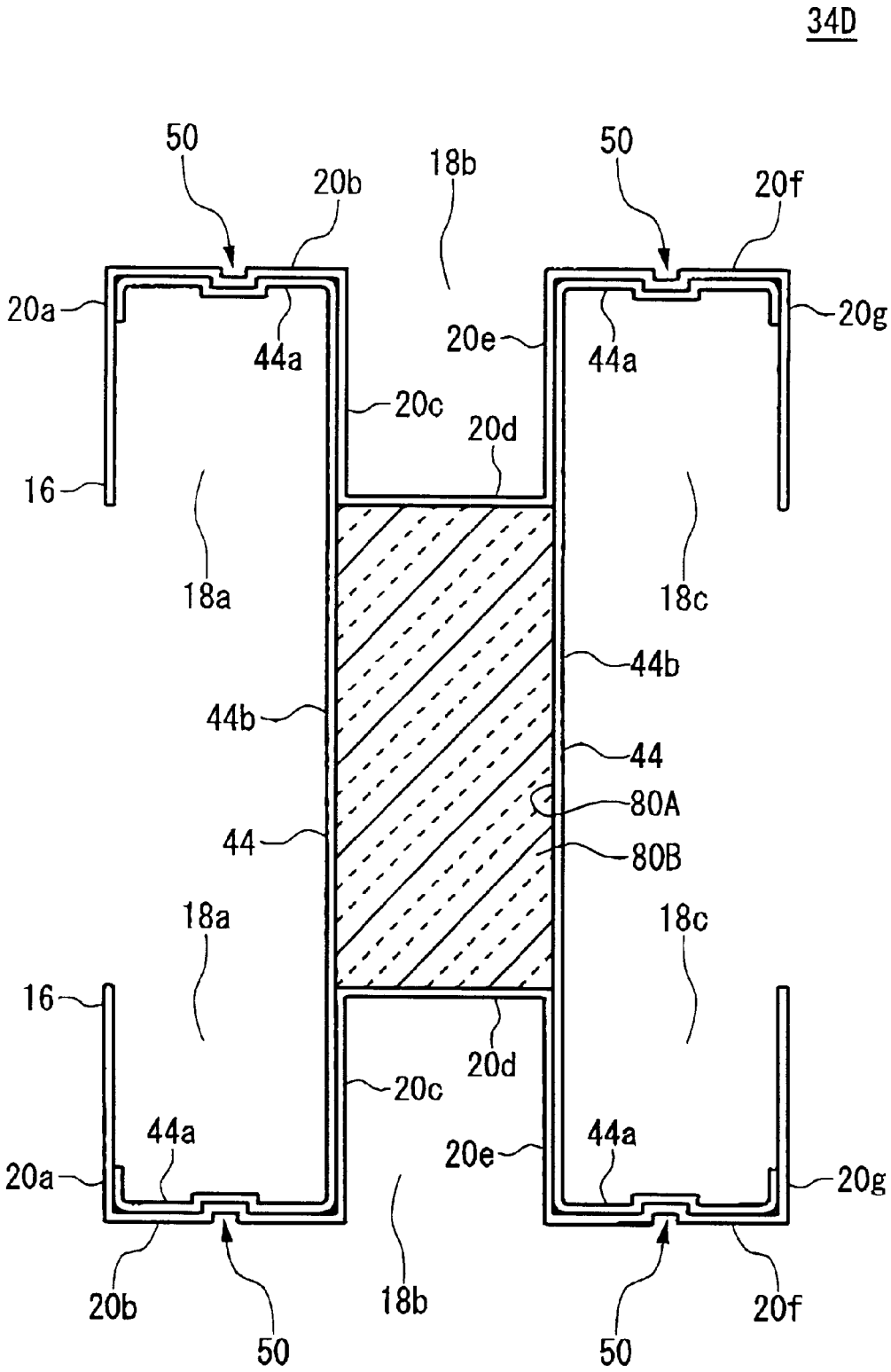
FIG. 15 shows another embodiment of the structural member.

FIG. 15 shows another embodiment of the structural member. The structural member 34D has a filling member 80B, which has the same shape as the shape of the space 80A, in the rectangular-shaped space 80A. The configuration is the same as the configuration of the structural member 34C of FIG. 13, and thus the explanations of which are abbreviated. The filling member 80B, which is substantially the same shape with the space 80A, fills substantially the entire space 80A inside the structural member 34D. A heat insulating material such as expanded polystyrene can be used as a filling member 80B.

By inserting the filling member 80B that has a heat insulating property inside the space 80A, the structural member 34D has a heat insulating property so that condensation inside a structure 30 can be reduced. Furthermore, by inserting the filling member 80B has a sound insulating property inside the space 80A, the noise inside the structure 30 and the noise from outside the structure 30 such as traffic noise can be reduced.

Furthermore, because the filling member 80S contacts substantially all of the inside faces of the space 80A to support the structural member 34D, the filling member 80B supplies a force that can resist the force which deforms the structural member 34D. Therefore, the compressive strength in the longitudinal direction of the structural member 34D and the bending strength when the force is applied vertically to the longitudinal direction of the structural member 34D further increases.

Similar to the structural member 34C, because the structural member 34D has a channel 18*a* and 18*c* that opens to the outside, the structural member 34D can be easily combined with the other structural member as explained in FIGS. 12A and 12B. Therefore, it is preferable to use structural member 34D for a straining beam 12 or a column 14 of the structure 30, which is a member to be connected and combined with other members.

Figure 16:
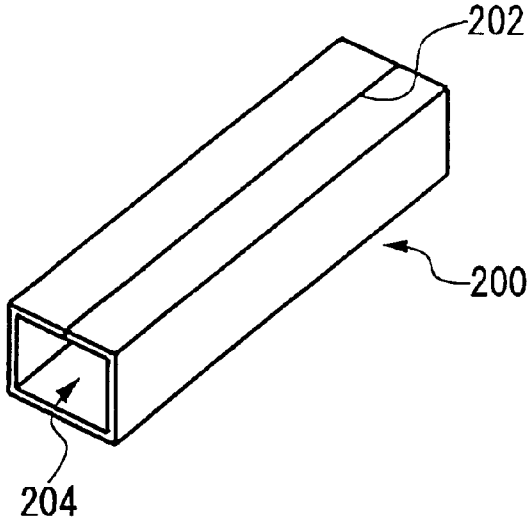
FIG. 16 shows a connector that is used for connecting at least two structural members.

FIG. 16 shows a connector that is used for connecting at least two structural members. The connector 200 is a pipe that has a substantially rectangular cross section. A space 204 is provided inside the connector 200. The connector 200 is made by bending a steel plate into a rectangular piped shape such that each end 202 of the steel plate connects with each other Because each end 202 of the steel plate is connected with each other, the connector is very strong. Therefore, the connector 200 can be used in a place where the most strength is needed such as connecting the structural members used for a main beam.

Figure 17:
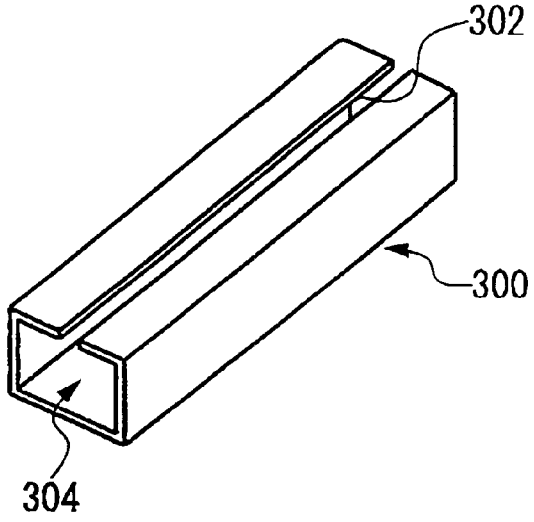

FIG. 17 shows another embodiment of a connector. The connector 300 is a pipe that has a substantially rectangular cross section. A space 304 is provided inside the connector 300. The connector 300 is made by bending a steel plate into a rectangular piped shape such that each end of the steel plate does not connect with each other. Therefore, the connector 300 has a slit 302. Because each end of the steel plate does not have to connect with each other, the connector 300 can be easily manufactured so that the cost of manufacturing the connector is low.

FIG. 18 and FIG. 19 show embodiments of structural units. FIG. 18 shows a perspective view of a structural unit 400. FIG. 19 shows a cross section of the structural unit shown in FIG. 18. A structural unit 400 has two structural members 32A shown in FIG. 2 and FIG. 3 and a connector 200. The connector 200 connects the two structural members 32A so they are parallel. The connector 300 can be used for connecting the structural member 32A instead of the connector 200.

One of the structural members 32A is set on another structural member 32A such that the second and the sixth planar portions 20*b* and 20*f* of the lower structural element 16 of the upper structural member 32A engage with the corresponding second and sixth planar portions 20*b* and 20*f* of the upper structural element 16 of the lower structural member 32A, respectively.

The connector 200 is inserted inside the space, which is formed by the third, fourth, and fifth planar portions 20*c*, 20*d*, and 20*e* of the lower structural element 16 of the upper structural member 32A and the third, fourth, and fifth planar portions 20*c*, 20*d*, and 20*e* of the upper structural element 16 of the lower structural member 32A. Because the connector 200 has a rectangular piped cross section, the connector 200 engages with the third, fourth, and fifth planar portions 20*c*, 20*d*, and 20*e* of the lower structural element 16 of the upper structural member 32A and the third, fourth, and fifth planar portions 20*c*, 20*d*, and 20*e* of the upper structural element 16 of the lower structural member 32A.

The upper face of the connector 200 is connected to the fourth planar portion 20*d* of the lower structural element 16 of the upper structural member 32A by a rivet 104. The connector 200 may also be connected to the upper structural member 32A by a drilling screw, a tapping screw, a screw nail, a bolt, or a welding. Furthermore, the lower face of the connector 200 is connected to the fourth planar portion 20*d* of the upper structural element 16 of the lower structural member 32A by a rivet 104. However, the structural member 32A may be connected to the connector 200 by a drilling screw, a tapping screw, a screw nail, a bolt, or a welding.

Moreover, the second and sixth planar portions 20*b* and 20*f* of the lower structural element 16 of the upper structural member 32A are connected to the second and sixth planar portions 20*b* and 20*f* of the upper structural element 16 of the lower structural member 32A by a rivet 104. However, the structural member 32A can be connected to each other by a drilling screw, a tapping screw, a screw nail, a bolt, or a welding.

The structural unit 400 can be used for making a floor of the structure 30 by connecting a plurality of structural units 400 in parallel by the connector 200. Here, the structural member 32A is used for making the structural unit 400 as an example. However, the structural member 32A–32F or 34A–34D shown from FIG. 2 to FIG. 15 may also be used for making the structural unit 400.

FIG. 20 shows an example of the structural unit that uses the structural member 34C instead of the structural member 32A. Similar to the structural element 400 shown in FIG. 18, two structural members 34C are connected in parallel by the connector 200. The structural unit 404 can be used for a main beam 10 that requires high bending strength.

FIG. 21 and FIG. 22 show embodiments of a structural unit. FIG. 21 shows a perspective view of a structural unit 402. FIG. 22 shows a cross section of the structural unit shown in FIG. 21. A structural unit 402 has two structural members 32A and a connector 200. The connector 200 connects two structural members 32A serially in a longitudinal direction. The connector 300 shown in FIG. 17 can be used for connecting the structural member 32A instead of the connector 200.

Two structural members 32A are arranged serially in a longitudinal direction such that one of the ends of the structural member 32A contacts with one of the ends of the other structural member 32A. Then, the connector 200 is inserted through the space 84A of both of the two structural members 32A. The connector 200 is connected to each of the fourth planar portions 20*d* of the upper and lower structural elements 16 of each of the two structural members 32A.

That is, one end of one of the plurality of structural members 32A is connected to one end of another structural member 32A serially in a longitudinal direction by the connector 200. Moreover, the connector 200 engages with both of the fourth planar portions 20*d* of the pair of structural elements 16 of one of the plurality of structural members 32A; and the connector 200 further engages with both of the fourth planar portions 20*d* of the pair of structural elements 16 of the other structural member 32A.

The upper face of the connector 200 is connected to the fourth planar portion 20*d* of the upper structural element 16 of the structural member 32A by a rivet 106. Furthermore, the lower face of the connector 200 is connected to the fourth planar portion 20*d* of the lower structural element 16 of the structural member 32A by a rivet 106. However, the structural member 32A can be connected to the connector 200 by a drilling screw, a tapping screw, a screw nail, a bolt, or a welding. Two structural members 32A thus constitute one piece of a column of the structural unit 402. The structural unit 402 can be used in a place that requires a large length such as a column provided through a plurality of floors of the structure 30. Here, the structural member 32A is used for making the structural unit 400 as an example. However, 25 the structural members 32A, 32C, 32E, 34A, and 34C may also be used for forming the structural unit 402.

FIG. 23 shows an embodiment of a structural unit when the structural member 34C is used for forming the structural unit 402 shown in FIG. 21 and FIG. 22 instead of using the structural member 32A. Similar to the structural unit 402 shown in FIG. 21, the structural unit 404 is formed by connecting two structural members 34C serially in a longitudinal direction by the connector 200. The connector 200 is inserted through a space 80A formed by each planar portion 20*d* of the structural elements 16 and each bottom face 44*b* of the channel sections 44 of each structural member 34C.

Therefore, the upper face of the connector 200 engages with the fourth planar portion 20*d* of the upper structural element 16 of the structural member 34C, and the lower face of the connector 200 engages with the fourth planar portion 20*d* of the lower structural element 16 of the structural member 34C. Furthermore, the left side face of the connector 200 engages with the bottom face 44*b* of the left side channel section 44 of the structural member 34C, and the right side face of the connector 200 engages with the bottom face 44*b* of the right side channel section 44 of the structural member 34C.

The upper face of the connector 200 is connected to the fourth planar portion 20*d* of the upper structural element 16 of the structural member 34C by a rivet 110. However, the structural member 34C can be connected to the connector 200 by a drilling screw, a tapping screw, a screw nail, a bolt, or a welding. Moreover, the lower face of the connector 200 is connected to the fourth planar portion 20*d* of the lower structural element 16 of the structural member 34C by a rivet 110. However, the structural member 34C can be connected to the connector 200 by a drilling screw, a tapping screw, a screw nail, a bolt, or a welding.

Similar to the structural unit 402 shown in FIG. 21 and FIG. 22, the structural unit 404 can also be used in a place that requires a large length such as a column provided through a plurality of floors of the structure 30.

As described above, the structural members 32A–32F and 34A–34D have a high compressive strength and bending strength, and the structural members 32A–32F and 34A–34D can also be used for such purposes as a main beam, a straining beam, or a column to construct a structure. Because the structural members 32A–32F and 34A–34D are formed from the structural element 16, the structural members 32A–32F and 34A–34D are light and can be easily assembled with each other. Therefore, even an ordinary person who is not a skilled technician can easily construct a structure such as a house using the structural members 32A–32F or 34A–34D.

Furthermore, because the structural members 32A–32F and 34A–34D can be mass-produced in a factory, the cost for manufacturing the structural members 32A–32F and 34A–34D can be greatly reduced. Furthermore, by selling the plurality of structural members 32A–32F and 34A–34D together with necessary construction materials as a single kit for constructing a house, even an ordinary person who is not a skilled technician can easily construct a structure such as a house using the structural members 32A–32F or 34A–34D.

Furthermore, by providing a filling member that has a heat insulating property inside the space of the structural members 32A–32F or 34A–34D, the heat insulating property of the structural member increases so that condensation inside the structure 30 decreases. Moreover, by providing the filling member that has a sound insulating property inside the space of the structural members 32A–32F or 34A–34D, the noise inside the structure and the noise from outside the structure such as traffic noise can be reduced. Furthermore, by providing a filling member inside the space of the structural members 32A–32F or 34A–34D, the compressive strength when the load is applied in the longitudinal direction of the structural members 32A–32F or 34A–34D increases. The bending strength when the load is applied vertically to the longitudinal direction of the structural members 32A–32F or 34A–34D can also be increased by providing the filling member inside the space of the structural members 32A–32F or 34A–34D.

Although the present invention has been described by way of exemplary embodiments, it should be understood that many changes and substitutions may be made by those skilled in the art without departing from the spirit and the scope of the present invention which is defined only by the appended claims.

What is claimed is:

1. A structural member for constructing a structure, comprising:

a pair of structural elements;

a connecting member connecting said pair of structural elements; and a filling member provided in a space formed by said pair of structural elements and said connecting member;

wherein each of the pair of structural elements includes three substantially rectangular channels opening alternately towards opposite directions when connected using the connecting member and has a substantially uniform cross section along a longitudinal direction, and having substantially equal heights;

has first, second, third, fourth, fifth, sixth, and seventh substantially rectangular planar portions, neighboring faces of which are substantially perpendicular to each other; and has an M-shaped configuration;

wherein said pair of structural elements are aligned and connected to each other by said connecting member such that each side channel of said three channels of one of said structural elements faces the corresponding side channels of another said structural element, respectively;

wherein said structural elements and said connecting member are made from steel;

wherein said connecting member is a pair of channel sections, wherein each of the pair of channel sections has a bottom face and two side faces and said two side faces of one channel section of said pair of channel sections engages with an inner face of said second planar portion of each of said pair of structural elements, and said two side faces of another channel section of said pair of channel sections engages with an inner face of said sixth planar portion of each of said pair of structural elements;

wherein said bottom face of one of said channel section of said pair of channel sections engages with each of inner faces of said first planar portion and said seventh portion of said pair of structural elements;

wherein said first and seventh and third and fifth planar portions of each of said pair of structural elements among a part where said structural element and said channel section engages have a concave part, which connects said structural element and said channel section;

wherein said first and seventh and third and fifth planar portions of each of said pair of structural elements among a part where said structural element and said channel section engages have a rivet, a drilling screw, a tapping screw, a screw nail, a bolt, or a welding, which connects said structural elements and said channel section; and wherein a space having a substantially H-shaped cross section is formed by said pair of channel sections and said pair of structural elements.

2. A structural member for constructing a structure, comprising:

a pair of structural elements;

a connecting member connecting said pair of structural elements; and a filling member provided in a space formed by said pair of structural elements and said connecting member;

wherein each of the pair of structural elements includes three substantially rectangular channels opening alternately towards opposite directions when connected using the connecting member and has a substantially uniform cross section along a longitudinal direction, and the heights of said three channels are substantially equal;

has first, second, third, fourth, fifth, sixth, and seventh substantially rectangular planar portions, neighboring faces of which are substantially perpendicular to each other; and has an M-shaped configuration;

wherein said pair of structural elements are aligned and connected to each other by said connecting member such that each side channel of said three channels of one of said structural elements faces the corresponding side channels of another said structural element, respectively;

wherein each structural element and said connecting member are made from steel;

wherein said connecting member is a pair of channel sections, each of which has a bottom face and two side faces;

wherein said two side faces of one channel section of said pair of channel sections engages with an outer face of said second planar portion of each of said pair of structural elements; and said two side faces of another channel section of said pair of channel sections engages with an outer face of said sixth planar portion of each of said pair of structural elements;

wherein said bottom face of one of said channel section of said pair of channel sections engages with each of outer faces of said first planar portion and said seventh portion of said pair of structural elements;

wherein said first and seventh and third and fifth planar portions of each of said pair of structural elements among a part where said structural element and said channel section engages have a concave part, which connects said pair of structural elements and said pair of channel sections;

wherein said first and seventh and third and fifth planar portions of each of said pair of structural elements among a part where said structural element and said channel section engages have a rivet, a drilling screw, a tapping screw, a screw nail, a bolt, or a welding, which connects said pair of structural elements and said pair of channel sections;

wherein a space having a substantially H-shaped cross section is formed by said pair of channel sections and said pair of structural elements.

3. A structural member for constructing a structure, comprising:

a pair of structural elements;

a connecting member connecting said pair of structural elements; and a filling member provided in a space formed by said pair of structural elements and said connecting member;

wherein each of the pair of structural elements includes three substantially rectangular channels opening alternately towards opposite directions when connected using the connecting member and has a substantially uniform cross section along a longitudinal direction, and the heights of said three channels are substantially equal;

has first, second, third, fourth, fifth, sixth, and seventh substantially rectangular planar portions, neighboring faces of which are substantially perpendicular to each other; and has an M-shaped configuration;

wherein said pair of structural elements are aligned and connected to each other by said connecting member such that each side channel of said three channels of one of said structural elements faces the corresponding side channels of another said structural element, respectively;

wherein each structural element and said connecting member are made from metal;

wherein said connecting member is a pair of steel plates, wherein each of the steel plates has a substantially rectangular plane;

wherein one steel plate of said pair of steel plates engages with the inner face of said first planar portions of each of said pair of structural elements;

another steel plate of said pair of steel plates engages with the inner face of said seventh planar portions of each of said pair of structural elements; and a space having a substantially H-shaped cross section is formed by said pair of steel plates and said pair of structural elements;

wherein said first and seventh portions of each of said pair of structural elements among a part where said structural element and said steel plates engage have a rivet, a drilling screw, a tapping screw, a screw nail, a bolt, or a welding, which connects said structural elements and said connecting member.

4. A structural member for constructing a structure, comprising:

a pair of structural elements;

a connecting member connecting said pair of structural elements; and a filling member provided in a space formed by said pair of structural elements and said connecting member;

wherein each of the pair of structural elements includes three substantially rectangular channels opening alternately towards opposite directions when connected using the connecting member and has a substantially uniform cross section along a longitudinal direction, and the heights of said three channels are substantially equal;

has first, second, third, fourth, fifth, sixth, and seventh substantially rectangular planar portions, neighboring faces of which are substantially perpendicular to each other; and has an M-shaped configuration;

wherein said pair of structural elements are aligned and connected to each other by said connecting member such that each side channel of said three channels of one of said structural elements faces the corresponding side channels of another said structural element, respectively;

wherein each structural element and said connecting member are made from metal;

wherein said connecting member is a pair of steel plates having a substantially rectangular plane;

wherein one of said steel plate of said pair of steel plates engages with the inner face of said third planar portions of each of said pair of structural elements;

another steel plate of said pair of steel plates engages with the inner face of said fifth planar portions of each of said pair of structural elements; and a space having a substantially rectangular-shaped cross section is formed by said pair of steel plates and said pair of structural elements;

wherein said third and fifth portions of each of said pair of structural elements among a part where said structural element and said steel plates engage have a rivet, a drilling screw, a tapping screw, a screw nail, a bolt, or a welding, which connects said structural elements and said connecting member.

5. A structural member for constructing a structure, comprising:

a pair of structural elements;

a connecting member connecting said pair of structural elements; and a filling member provided in a space formed by said pair of structural elements and said connecting member;

wherein each of the pair of structural elements include three substantially rectangular channels opening alternately towards opposite directions when connected using the connecting member and has a substantially uniform cross section along a longitudinal direction, and the heights of said three channels are substantially equal;

has first, second, third, fourth, fifth, sixth, and seventh substantially rectangular planar portions, neighboring faces of which are substantially perpendicular to each other; and has an M-shaped configuration;

wherein said pair of structural elements are aligned and connected to each other by said connecting member such that each side channel of said three channels of one of said structural elements faces the corresponding side channels of another said structural element, respectively;

wherein each structural element and said connecting member are made from steel;

wherein said connecting member is a pair of channel sections, each of which has a bottom face and two side faces;

wherein said two side faces of one channel section of said pair of channel sections engages with an inner face of said second planar portion of each of said pair of structural elements; and said two side faces of another channel section of said pair of channel sections engages with an inner face of said sixth planar portion of each of said pair of structural elements;

wherein said bottom face of one of said channel section of said pair of channel sections engages with each of inner faces of said third planar portion and said fifth portion of said pair of structural elements;

wherein said second and sixth planar portions of each of said pair of structural elements among a part where said structural element and said channel section engages have a concave part, which connects said pair of structural elements and said pair of channel sections;

wherein said second and sixth planar portions of each of said pair of structural elements among a part where said structural element and said channel section engages have a rivet, a drilling screw, a tapping screw, a screw nail, a bolt, or a welding, which connects said pair of structural elements and said pair of channel sections;

wherein a space having a substantially rectangle-shaped cross section is formed by said pair of channel sections and said pair of structural elements.

6. A structural unit for constructing a structure, comprising:

at least two structural members; and a connecting member which connects the at least two structural members, wherein each of the at least two structural members including a pair of structural elements;

wherein each of the included pair of structural elements includes three substantially rectangular channels opening alternately towards opposite directions, has a substantially uniform cross section along a longitudinal direction, and has first, second, third, fourth, fifth, sixth, and seventh rectangular planar portions; and wherein neighboring faces of the rectangular planar portions are substantially perpendicular to each other, and are aligned and connected to each other by said connecting member such that each of the side channels of said three channels of one of said structural elements faces the corresponding side channels of another said structural element, respectively.

7. A structural unit as claimed in claim 6, wherein a pair of said structural members are connected by said connector such that said second and sixth planar portions of said structural element of one of said pair of structural members engage with said second and sixth planar portions of said structural element of another said structural member, respectively.

8. A structural unit as claimed in claim 7, wherein said connector is a pipe having a substantially rectangular cross section.

9. A structural unit as claimed in claim 8, wherein said connector engages with said third, fourth, and fifth planar portions of one of said pair of structural members and said connector further engages with said third, fourth, and fifth planar portions of another said structural member.

10. A structural unit as claimed in claim 6, wherein one end of one of said at least two structural members is connected to one end of another said at least two structural members serially in a longitudinal direction by said connector.

11. A structural unit as claimed in claim 10, wherein said connector is a pipe having a substantially rectangular cross section.

12. A structural unit as claimed in claim 11, said connector engages with each of said fourth planar portions of said pair of structural elements of one of said at least two structural members; and said connector further engages with each of said fourth planar portions of said pair of structural elements of another said structural member.

13. A method for manufacturing a structural unit that constitutes a structure comprising:

forming a structural member by forming a structural element by bending a steel plate to form three channels alternately opening towards opposite directions;

connecting a pair of said structure elements by a connecting member; and connecting at least two structural elements by a connector, wherein said forming said structural element forms each of said three channels of said structural element substantially rectangular, and bends said steel plate such that neighboring faces of which are perpendicular to each other, thus forming first, second, third, fourth, fifth, sixth, and seventh substantially rectangular planar portions;

wherein said connecting said pair of structural elements aligns said pair of structural elements such that each of the side channels of said three channels of one of said structural elements faces corresponding side channels of another said structural element, respectively, and connects aligned said pair of structural elements by said connecting member.

14. A method for manufacturing a structural unit as claimed in claim 13, wherein said connecting said at least two structural members connects said at least two structural members such that said second and sixth planar portions of said structural element of one of said at least two structural members engages with said second and sixth planar portions of said structural element of another said structural member, respectively.

15. A method for manufacturing a structural unit as claimed in claims 14, wherein a pipe that has a substantially rectangular cross section is used for said connector.

16. A method for manufacturing a structural unit as claimed in claim 15, wherein said connecting said at least two structural members arranges said connector to be engaged with said third, fourth, and fifth planar portions of one of said pair of structural members and to be engaged with said third, fourth, and fifth planar portions of another said structural member.

17. A method for manufacturing a structural unit as claimed in claim 13, wherein said connecting said at least two structural members connects one end of one of said at least two structural members to one end of another said structural member serially in a longitudinal direction by said connector.

18. A method for manufacturing a structural unit as claimed in claim 17, wherein a pipe that has a substantially rectangular cross section is used for said connector.

19. A method for manufacturing a structural unit as claimed in claim 18, wherein said connecting said at least two structural members connects said at least two structural members by said connector such that said connector engages with each of said fourth planar portions of said pair of structural elements of one of said at least two structural members, and said connector further engages with each of said fourth planar portions of said pair of structural elements of another said structural member.

* * * * *